US008317665B2

(12) United States Patent
Webber et al.

(10) Patent No.: US 8,317,665 B2
(45) **Date of Patent: *Nov. 27, 2012**

(54) EXERCISE MACHINE WITH PIVOTING USER SUPPORT

(75) Inventors: Randall T. Webber, La Jolla, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 4 days.

This patent is subject to a terminal disclaimer.

(21) Appl. No.: 12/900,230

(22) Filed: Oct. 7, 2010

(65) Prior Publication Data

US 2011/0028283 A1 Feb. 3, 2011

Related U.S. Application Data

(63) Continuation of application No. 12/327,692, filed on Dec. 3, 2008, now Pat. No. 7,993,251, which is a continuation-in-part of application No. 11/846,437, filed on Aug. 28, 2007, now Pat. No. 7,549,949, which is a continuation-in-part of application No. 10/633,805, filed on Aug. 4, 2003, now Pat. No. 7,594,880.

(60) Provisional application No. 60/992,775, filed on Dec. 6, 2007, provisional application No. 60/824,575, filed on Sep. 5, 2006.

(51) Int. Cl.
*A63B 21/00* (2006.01)

(52) U.S. Cl. ..... 482/97; 482/100; 482/137

(58) Field of Classification Search ..... 482/96, 482/95, 137, 100, 130, 142
See application file for complete search history.

(56) References Cited

U.S. PATENT DOCUMENTS

| | | | | |
|---|---|---|---|---|
| 3,640,528 | A * | 2/1972 | Proctor | 482/102 |
| 4,231,568 | A * | 11/1980 | Riley et al. | 482/130 |
| 4,300,760 | A * | 11/1981 | Bobroff | 482/96 |
| 4,700,946 | A * | 10/1987 | Breunig | 482/57 |
| 4,743,010 | A * | 5/1988 | Geraci | 482/72 |
| 4,844,456 | A * | 7/1989 | Habing et al. | 482/100 |

* cited by examiner

*Primary Examiner* — Jerome w Donnelly
(74) *Attorney, Agent, or Firm* — Procopio Cory Hargreaves & Savitch LLP

(57) ABSTRACT

An exercise machine has a stationary main frame, a pivotally mounted user support frame, a user engagement device pivotally mounted on one of the frames for engagement by the user in performing an exercise, and a connecting link which links movement of the user engagement device to movement of the user support frame. A load resists movement of one of the moving parts of the machine. An elongate flexible, load-bearing connecting linkage extends between the load and user support frame, and first and second anchors are selectively connectible to a first end of the load-bearing connecting linkage to vary the resistance felt by a user. At least one of the anchors is located on the user support frame.

36 Claims, 25 Drawing Sheets

EXERCISE MACHINE WITH PIVOTING USER SUPPORT

RELATED APPLICATION

The present application is a continuation of U.S. patent application Ser. No. 12/327,692 filed on Dec. 3, 2008, which claims the benefit of U.S. provisional patent application No. 60/992,775 filed Dec. 6, 2007, which is incorporated herein by reference in its entirety, and which is also a Continuation-In-Part of U.S. patent application Ser. No. 11/846,437 filed on Aug. 28, 2007, now U.S. Pat. No. 7,549,949 issued on Jun. 23, 2009, which claims the benefit of U.S. provisional application No. 60/824,575 filed Sep. 5, 2006 and which is a Continuation-In-Part of U.S. patent application Ser. No. 10/633,805 filed on Aug. 4, 2003, now U.S. Pat. No. 7,594,880 issued on Sep. 29, 2009, and the contents of each of the aforementioned applications are also incorporated herein by reference in their entirety.

BACKGROUND

1. Field of the Invention

This invention relates generally to an exercise machine, and is particularly concerned with an exercise machine having a pivoting user support.

2. Related Art

A chest or pectoral ("pec") fly exercise works the pectoral muscles, as well as the biceps and deltoid to a lesser extent. In a free weight pec fly exercise, the exerciser lies on a bench facing upwards with a weight in each hand, arms extended out to the side, and palms facing up, with the elbows bent. In the start position, the hands should be slightly below the shoulders. The exerciser then lifts the weights to bring the dumbbells together over their body with a slight arcing or elliptical pattern to the movement. Similar exercises are performed with the exerciser in a declined position on a downwardly reclined back rest, and in an inclined position on an upwardly inclined back rest, in order to carry out decline and incline pec fly exercises, involving different muscles in the chest.

Various exercise machines have been designed in order to duplicate one or more of the free weight, upper body exercises such as pec fly, rear deltoid, chest press, and mid row. Typically, these machines have pivoted arms linked to an exercise resistance. They often do not accurately duplicate the movements of a free weight pec fly exercise. This is particularly the case with machines that try to combine two or more of the free weight, upper body exercises, due to the differences between the exercise movements.

The earliest pec fly machine had two independent exercise arms pivotally mounted on a frame above the user's head. The arms were generally L-shaped with a pivot shaft attached to the end of one leg of the L and a pad or roller attached to the other leg. The user sat on a seat mounted on the frame with their upper arms parallel to the floor and forearms bent 90 degrees at the elbow. With their forearms resting against the pads, the user rotated their arms forward until they came together. Since the exercise arms had only one pivot, they could only move in a concentric or circular pattern, and the arms were non-adjustable for different users.

In prior U.S. Pat. Nos. 6,579,213 and 6,988,977 of Webber et al., and co-pending application Ser. No. 10/634,299 of Webber et al., filed Aug. 5, 2003, the contents of each of which is incorporated herein by reference in its entirety, multi-pivot exercise arm assemblies are described which may be used in machines designed for performing various upper body exercises, including pectoral fly exercises. The exercise arm assembly in these prior patents and application has a main arm pivoted to a frame for pivoting about a first pivot axis, a swing arm pivoted to the main arm for pivoting about a second pivot axis, and a handle pivoted to the swing arm which pivots about a third pivot axis. This articulated motion allows the exerciser to perform a seated pec fly exercise in which the arms rotate forward in a more elliptical movement pattern, which more closely duplicates the natural movement of a free weight pec fly exercise.

SUMMARY

A pec fly exercise machine in one embodiment has a stationary main frame, a user support frame pivotally mounted on the main frame and having primary and secondary user supports which support spaced positions on a user's body in the same relative positions throughout an exercise movement, a user engagement device or exercise arm assembly pivotally mounted on one of the frames for engagement by the user in performing a pectoral fly exercise, and a connecting link which links movement of the user engagement device to movement of the user support frame. A load resists movement of one of the moving parts of the machine. The user support frame has an exercise start position which supports a user's body in a slightly rearward reclined position, and movement of the user engagement device moves the user support from the start position to an end position in which a user's body is in a more rearwardly reclined position.

The user support frame in one embodiment supports the user in a seated position and has a primary support which is a seat pad and a secondary support which is a back rest, and is pivotally mounted on the main frame by a pivot mount. In one embodiment, a foot support mounted at a forward end of the user support frame supports the user's feet throughout the exercise.

In one embodiment, the user engagement device comprises an exercise arm assembly pivotally mounted on the main frame with articulated arm portions on each side of the user support frame. Each arm portion has a main arm pivoted to the frame for rotation about a first pivot axis, a swing arm pivoted to the main arm for rotation about a second pivot axis, and a handle pivoted to the swing arm for rotation about a third pivot axis. One or more of the exercise arm pivot axes may be vertical, parallel axes while at least one is non-vertical and is not parallel to either of the other pivot axes. In another embodiment, all of the pivot axes are parallel to one another. In one embodiment, the main arms are pivoted to the frame beneath the user support. In another embodiment, the main arms are pivoted to an upper portion of the frame above the user support.

In another embodiment, the user engagement device comprises user engageable handles linked to at least one of the frames by a flexible member or cable. The user engageable handles may be flexible strap handles. In this embodiment, the user can determine the travel path of the user engaging handles or grips so as to perform upper body exercises such as a basic pec fly, incline fly, or decline fly exercise.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for exercise machines with a self-aligning pivoting seat or user support, designed for performing chest or pectoral ("pec") fly exercises. In certain embodiments disclosed herein, a user support frame is pivotally mounted on a stationary main frame, a user engagement device or exercise arm assembly is pivotally mounted on one of the frames for engagement by the user, and a connecting link links movement of the user engagement device to movement of the user support frame. A load resists movement of one of the moving parts of the machine.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 3:
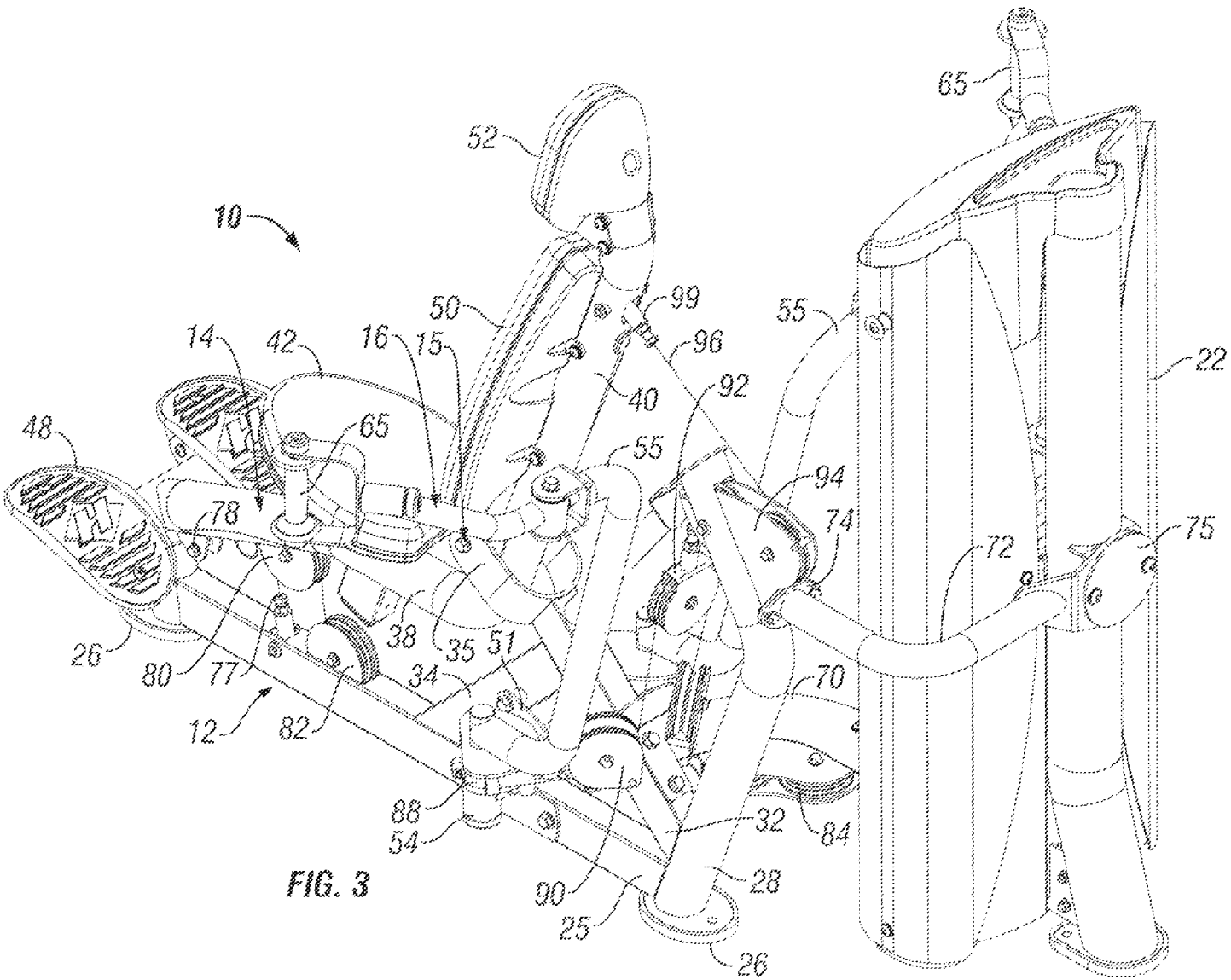
FIG. 3 is a rear perspective view of the machine of FIGS. 1 and 2.
Figure 4:
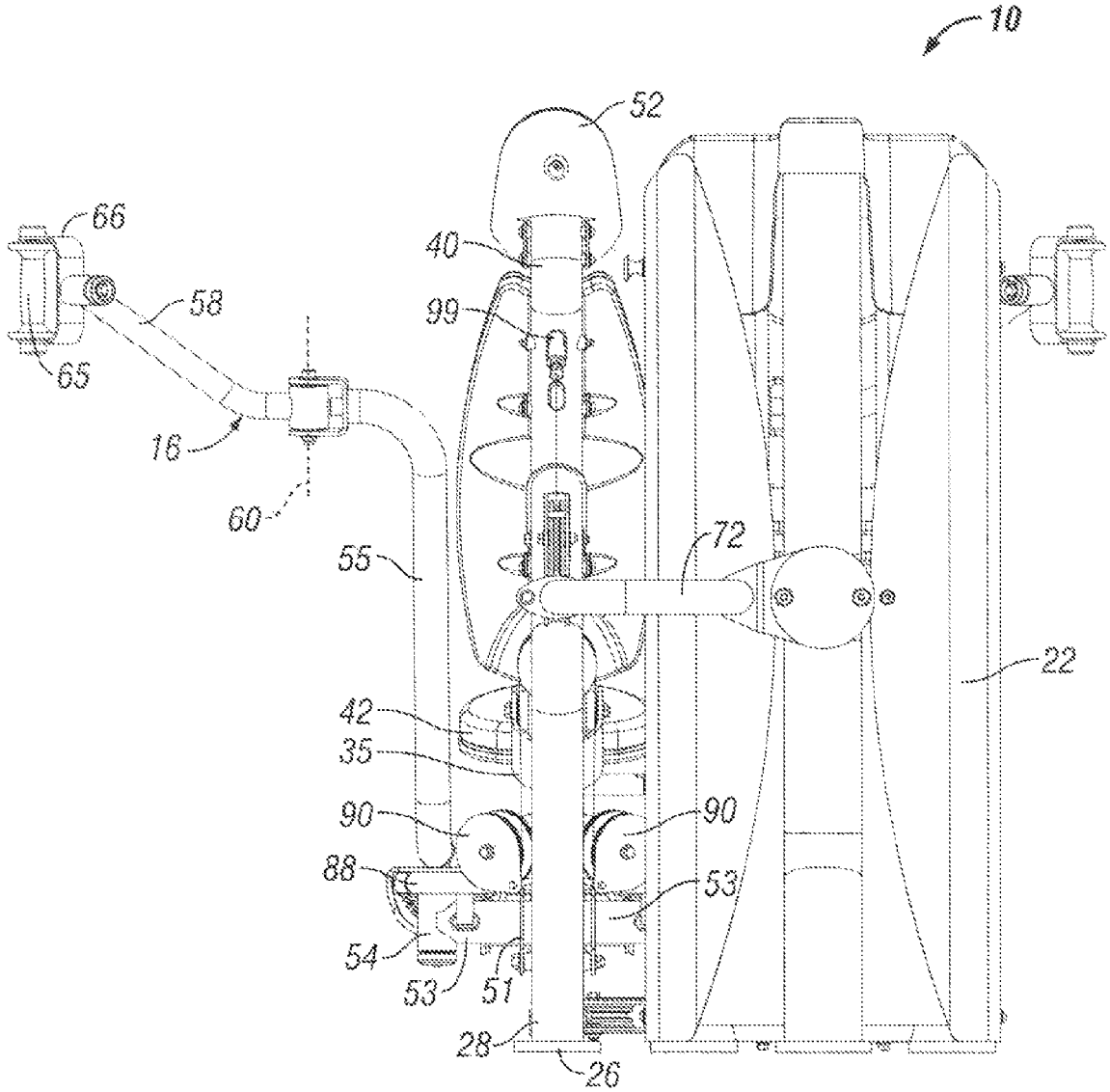
FIG. 4 is a rear elevation view of the machine of FIGS. 1 to 3.
Figure 5:
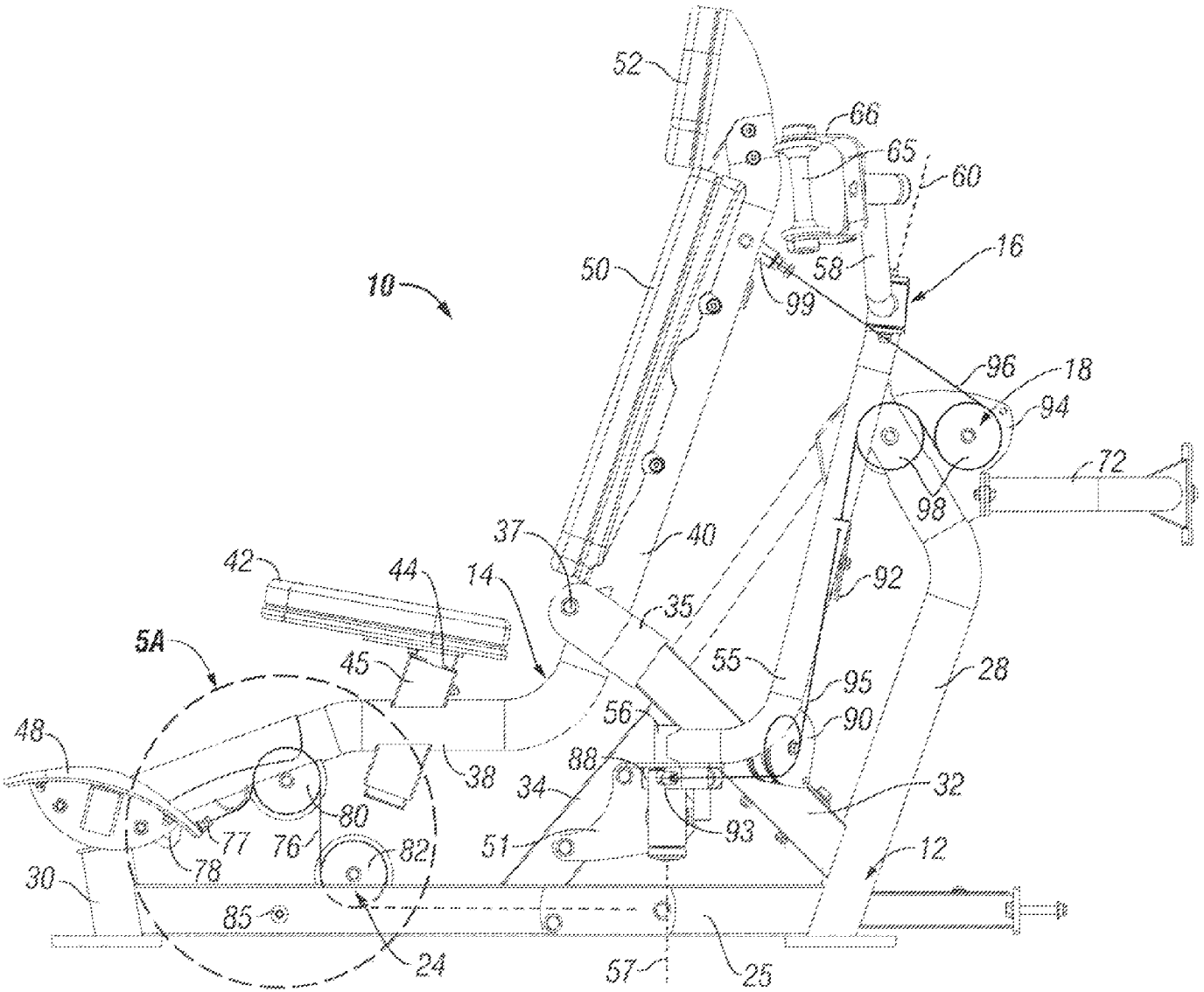
FIG. 5 is a side elevation view of the machine of FIGS. 1 to 4 in a start position for a pec fly exercise, showing the cabling.
Figure 6:
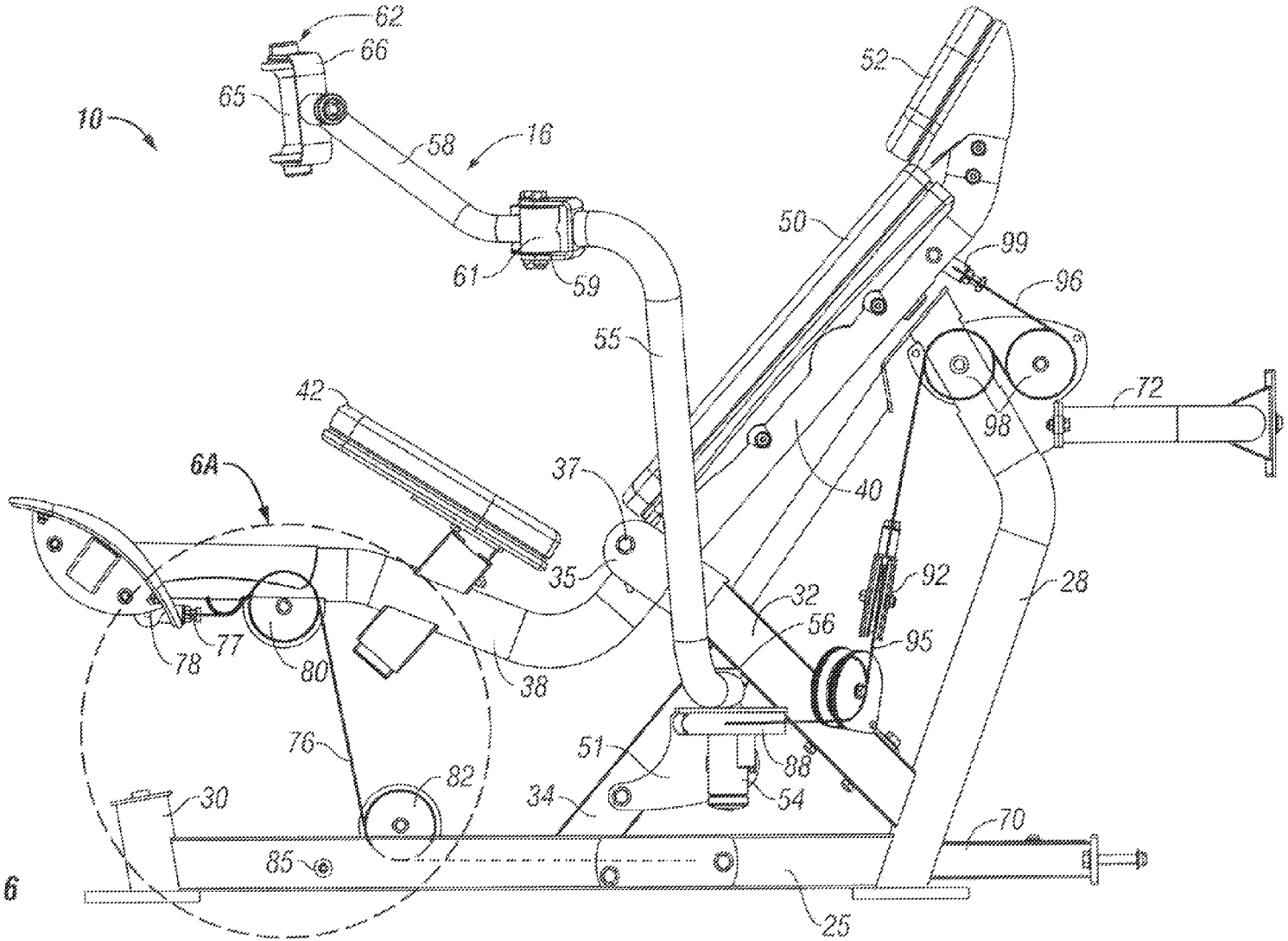
FIG. 6 is a side elevation view similar to FIG. 5 but illustrating an end position for a pec fly exercise.
Figure 6A:
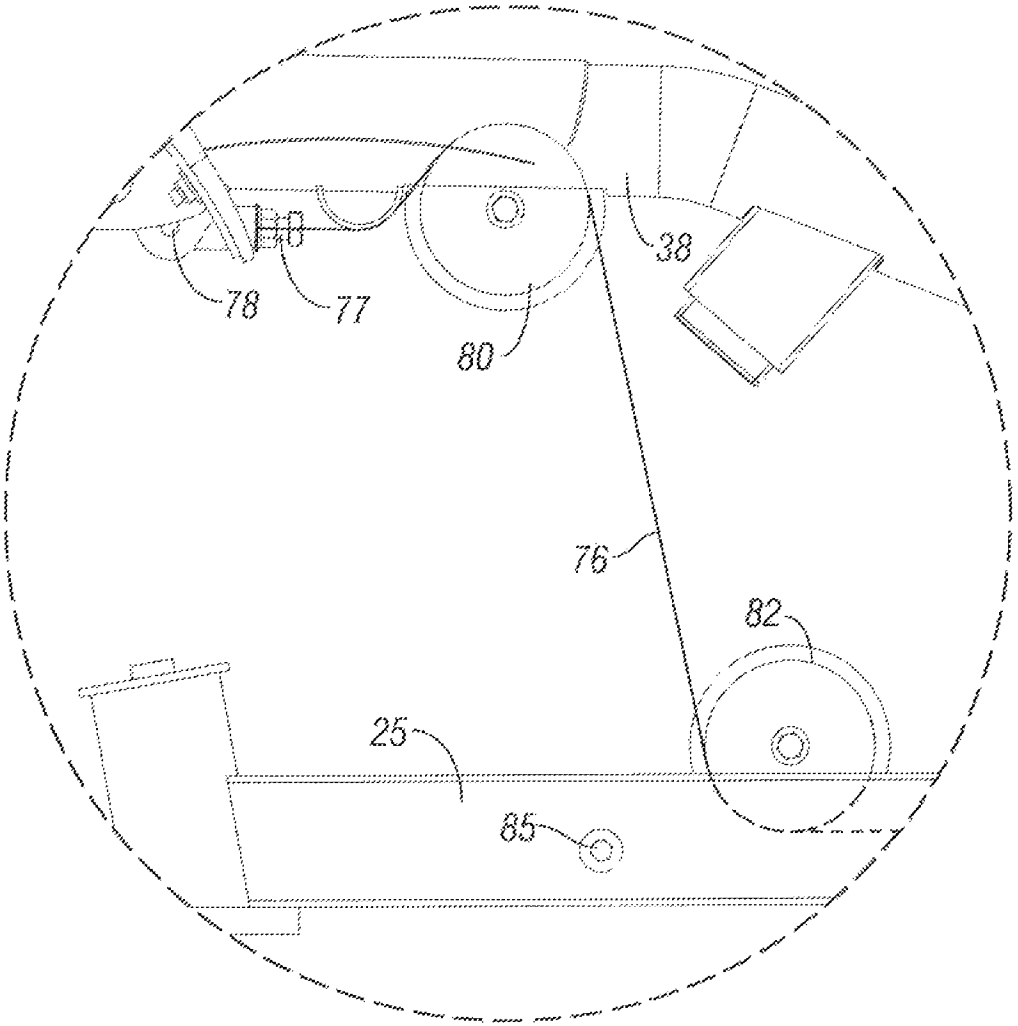
FIG. 6A is an enlarged side elevation view of the circled portion of FIG. 6, showing cable connection from the user support frame to the main frame in the exercise end position.
Figure 7:
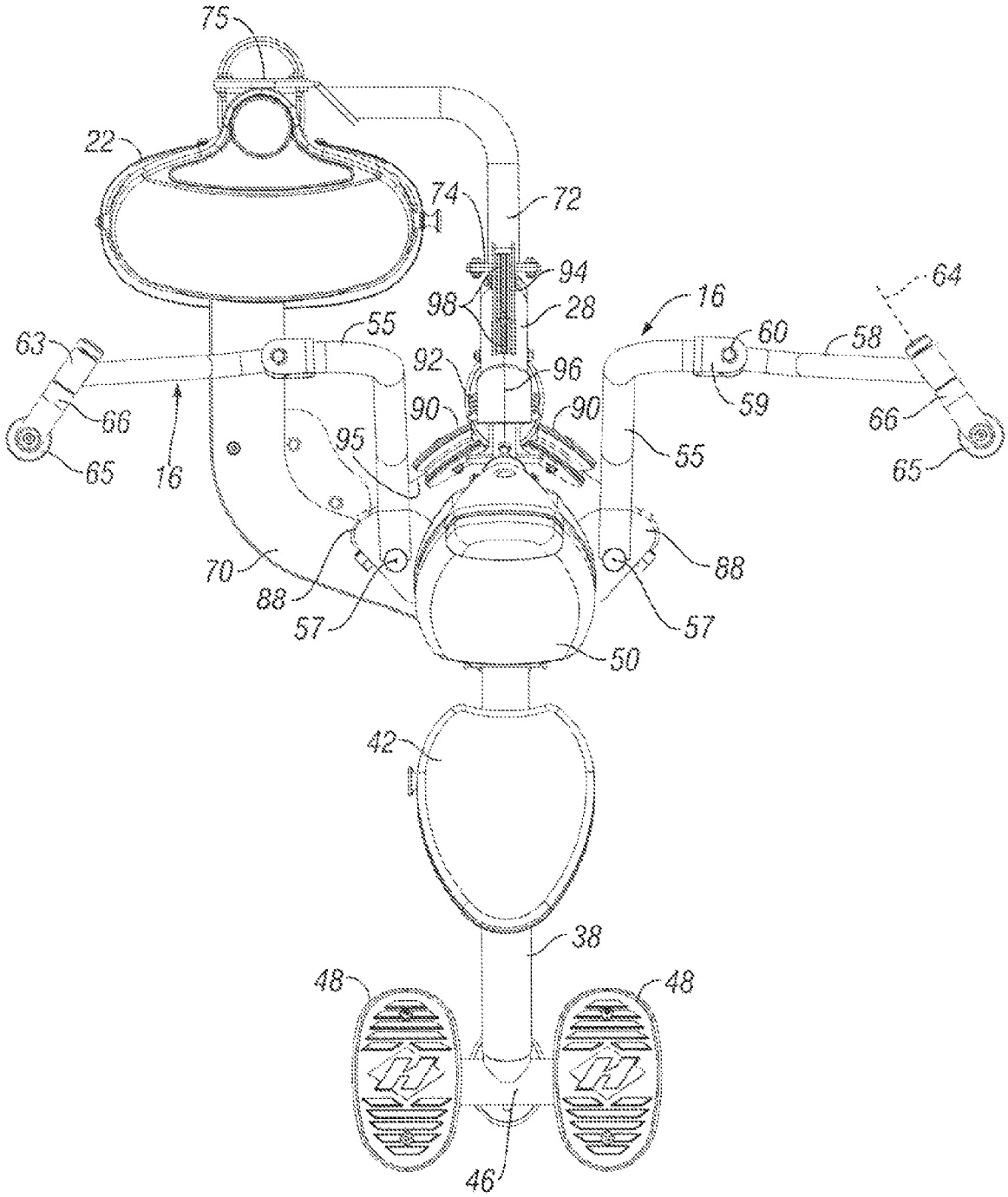
FIG. 7 is a top plan view of the machine of FIGS. 1 to 6 in an exercise start position.
Figure 8:
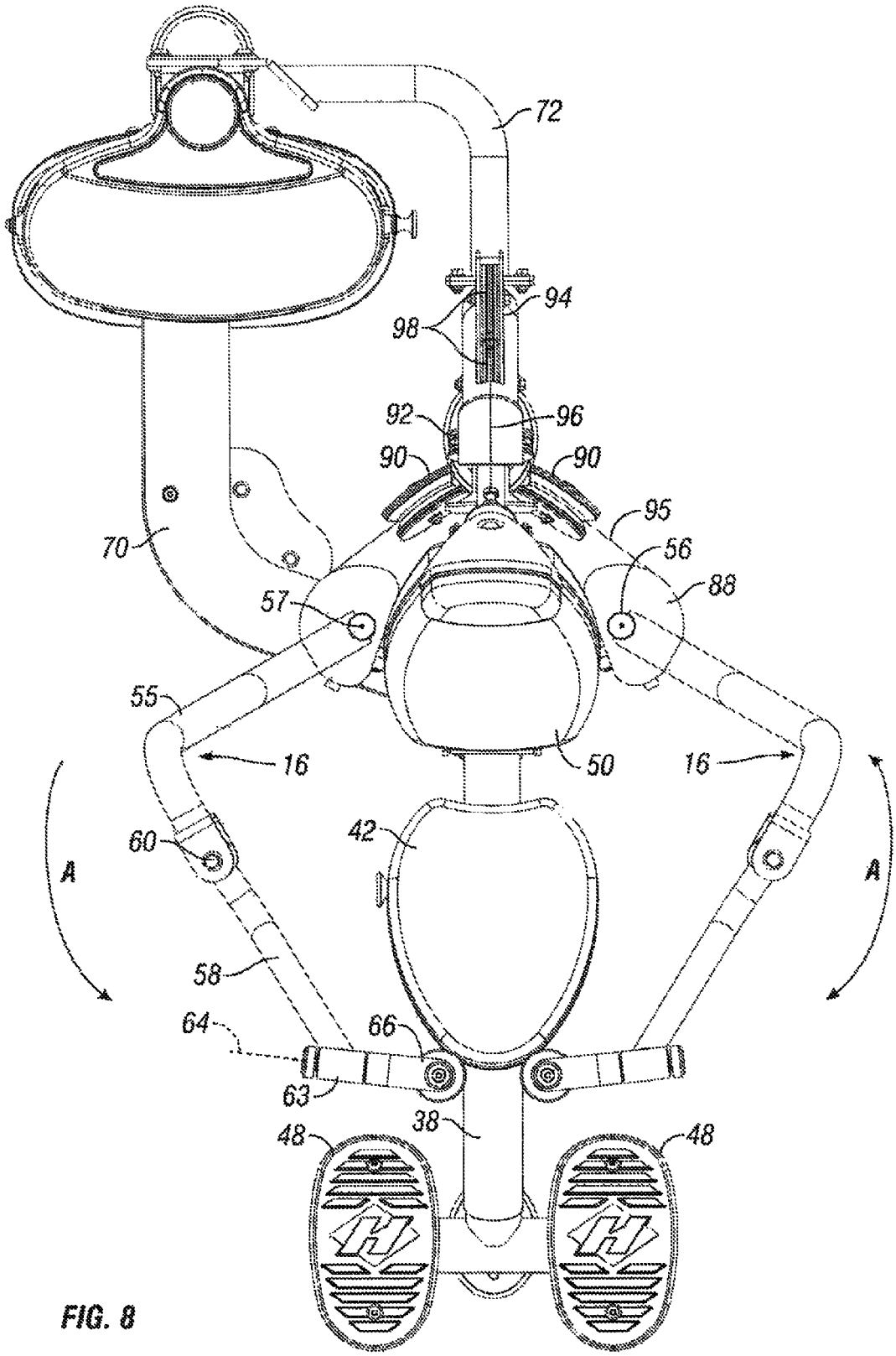
FIG. 8 is a top plan view similar to FIG. 7 but illustrating the machine in an exercise end position.
Figure 9:
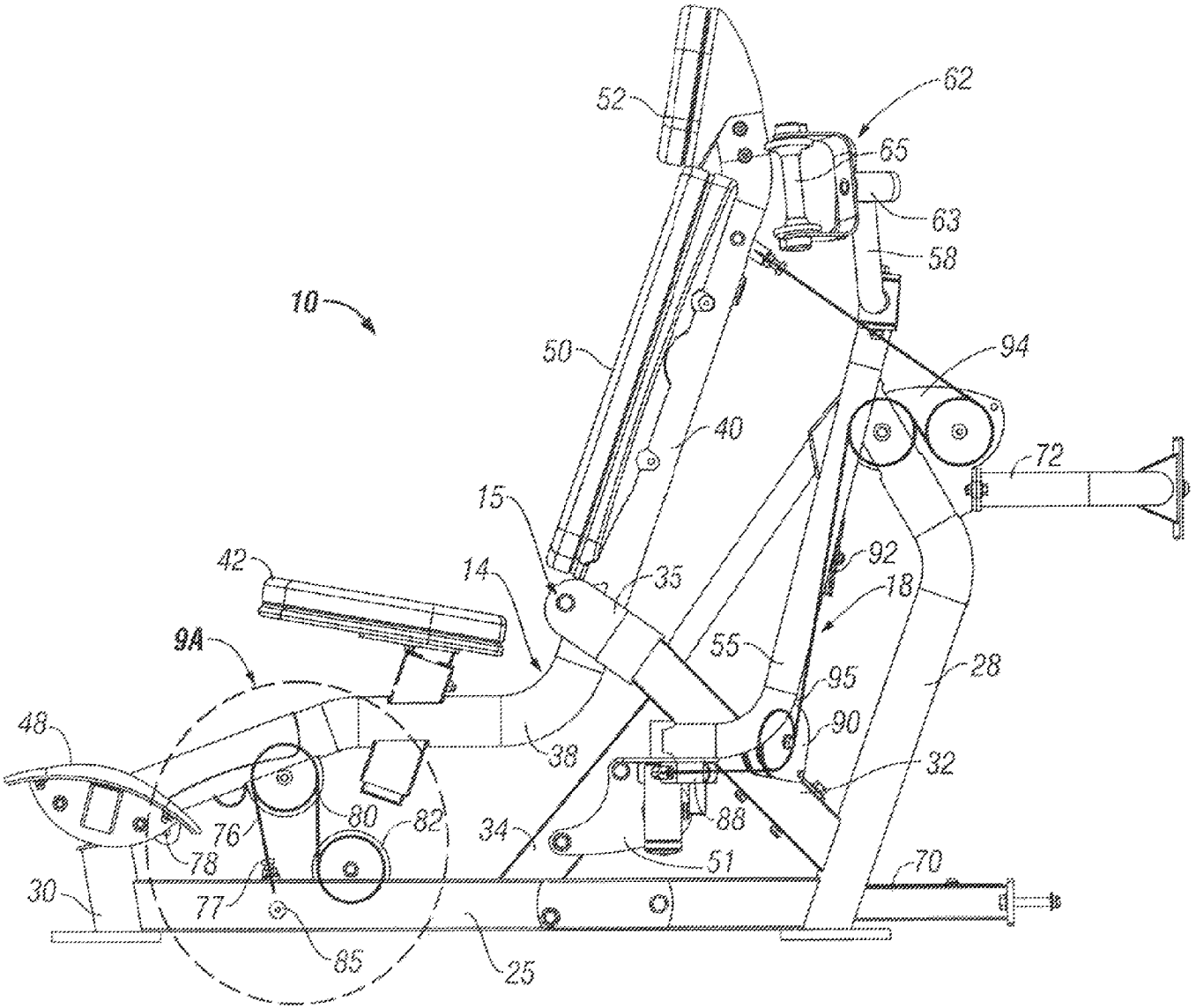
FIG. 9 is a side elevation view similar to FIG. 5 with the machine in an exercise start position, but illustrating an alternative cabling option.
Figure 10:
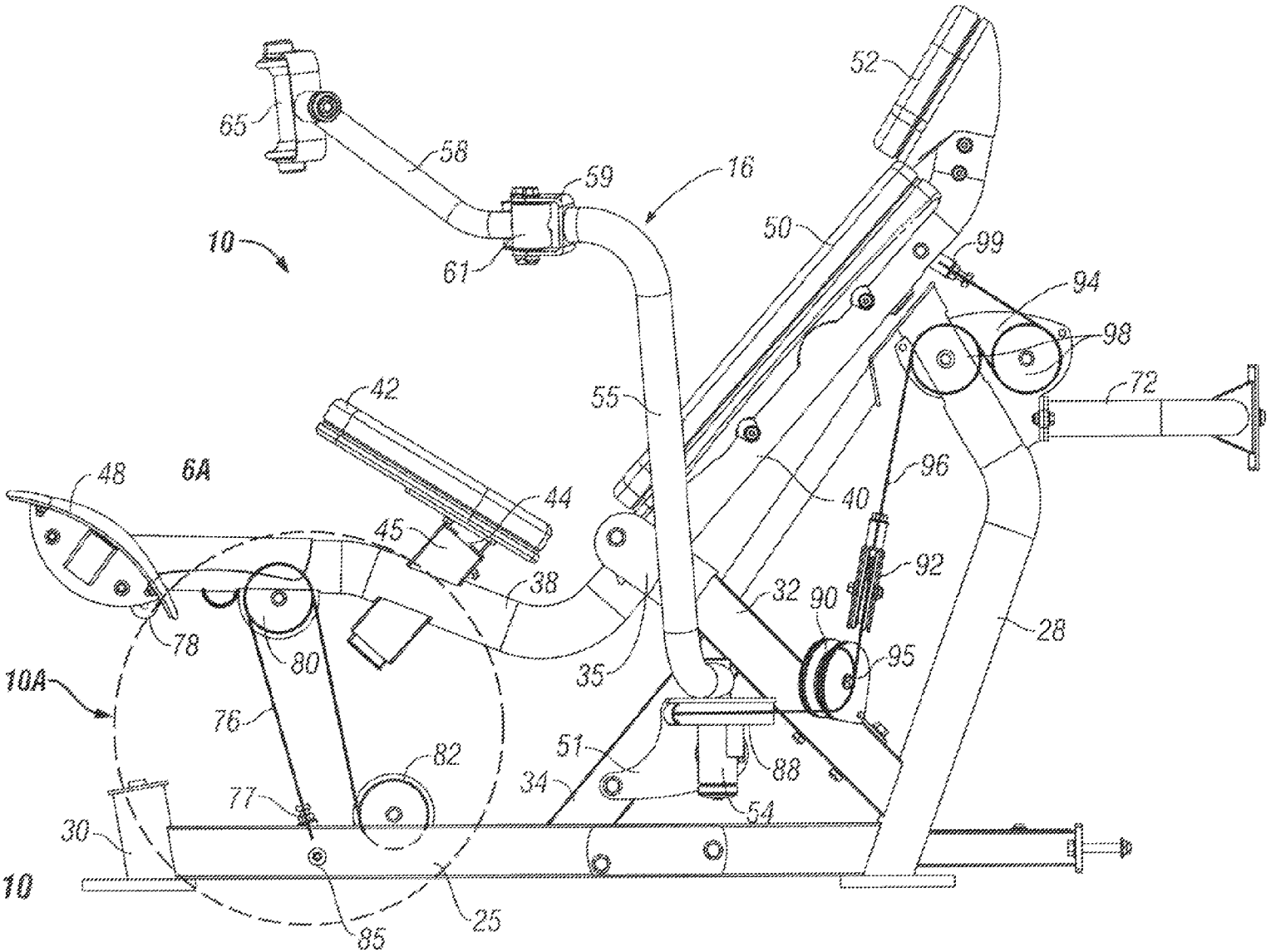
FIG. 10 is a side elevation view similar to FIG. 6 with the machine in an exercise end position, but showing the alternative cabling option of FIG. 9.
Figure 10A:
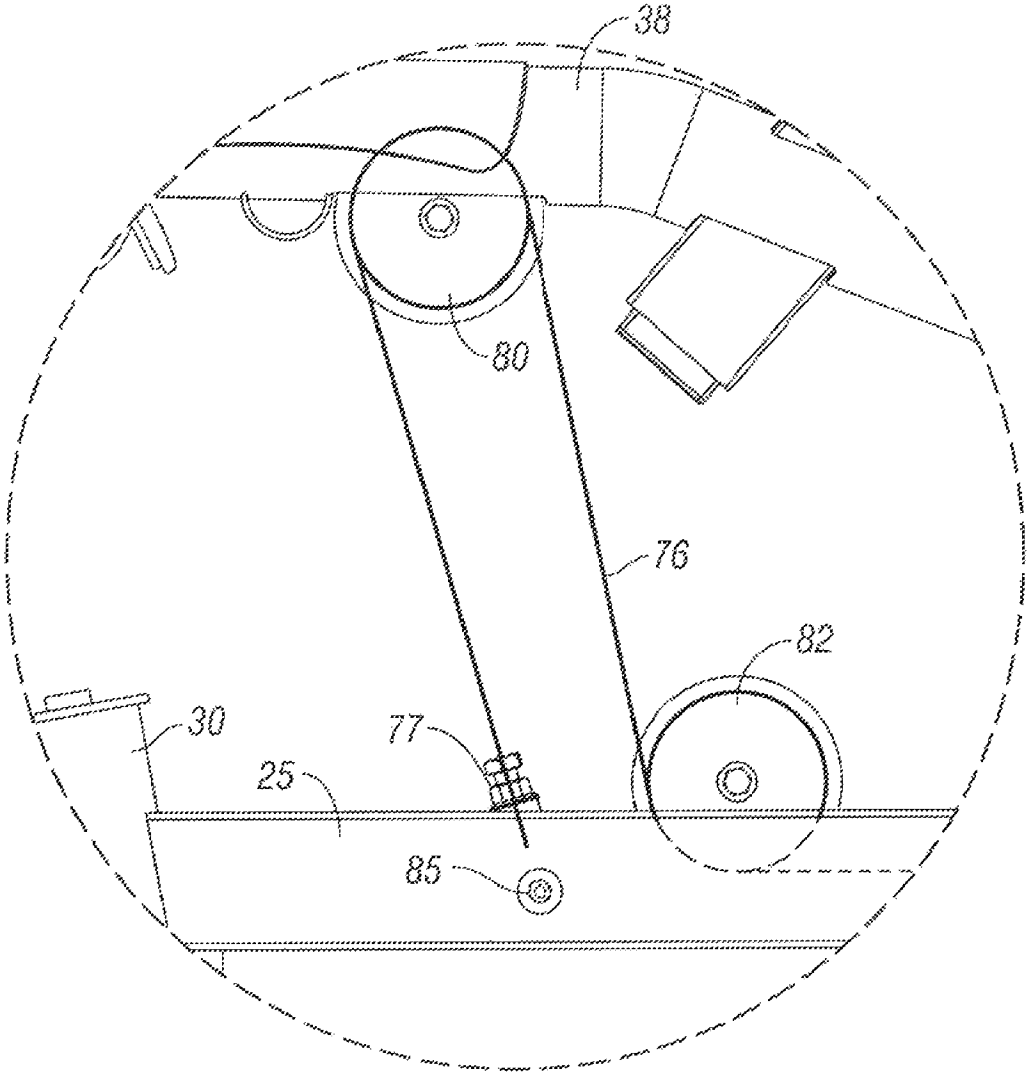
FIG. 10A is an enlarged side elevation view of the circled portion of FIG. 10, showing the cable path between the user support frame and the main frame in the exercise end position.

FIGS. 1 to 10A illustrate a pec fly exercise machine 10 according to a first embodiment, with FIGS. 5 to 6A illustrating a first cabling option and FIGS. 9 to 10A illustrating a second cabling option, as discussed in more detail below. Machine 10 has a stationary main frame 12, a user support frame 14 pivotally mounted on the frame via a pivot mount 15, and a pair of multi-part, articulating exercise arms 16 pivotally mounted on the main frame and linked to the user support frame via a cable and pulley linkage 18 (FIG. 5), so that movement of the exercise arm assembly results in pivoting movement of the user support. The user support 14 is linked to a weight stack 20 mounted in weight stack frame or housing 22 (FIG. 2) via a cable and pulley linkage 24 (FIG. 5). Cabling is omitted in FIGS. 1 to 4, 7 and 8 for clarity, but is shown in FIGS. 5 to 6A, with a modified cabling path to the weight stack in FIGS. 9 to 10A. The machine of FIGS. 1 to 10A is designed for performing a pec fly exercise with the user support frame starting in a slightly reclined position, as illustrated in FIGS. 5 and 9, and ending in a more reclined position, as illustrated in FIGS. 6 and 10.

The pec fly exercise machine 10 is similar in some respects to the pec fly exercise machine illustrated in FIGS. 25 to 28 of co-pending application Ser. No. 10/633,805 filed on Aug. 4, 2003 and referenced above, and the entire contents of this prior co-pending application are incorporated herein by reference. However, the user support frame in that machine was of a different design and had a different pivot mount to the main frame, and was designed to perform a combination pectoral fly exercise which included more shoulder muscle involvement than this embodiment. The start position of the pec fly machine in that application was forwardly inclined rather than slightly reclined, so that the user moved from an incline to a straight to a decline fly exercise between the exercise start and end positions. This involves the upper, mid, and lower pectoral muscle groups and also includes more shoulder muscle involvement than the pec fly machine 10, which may not be desirable in all cases.

Figure 1:
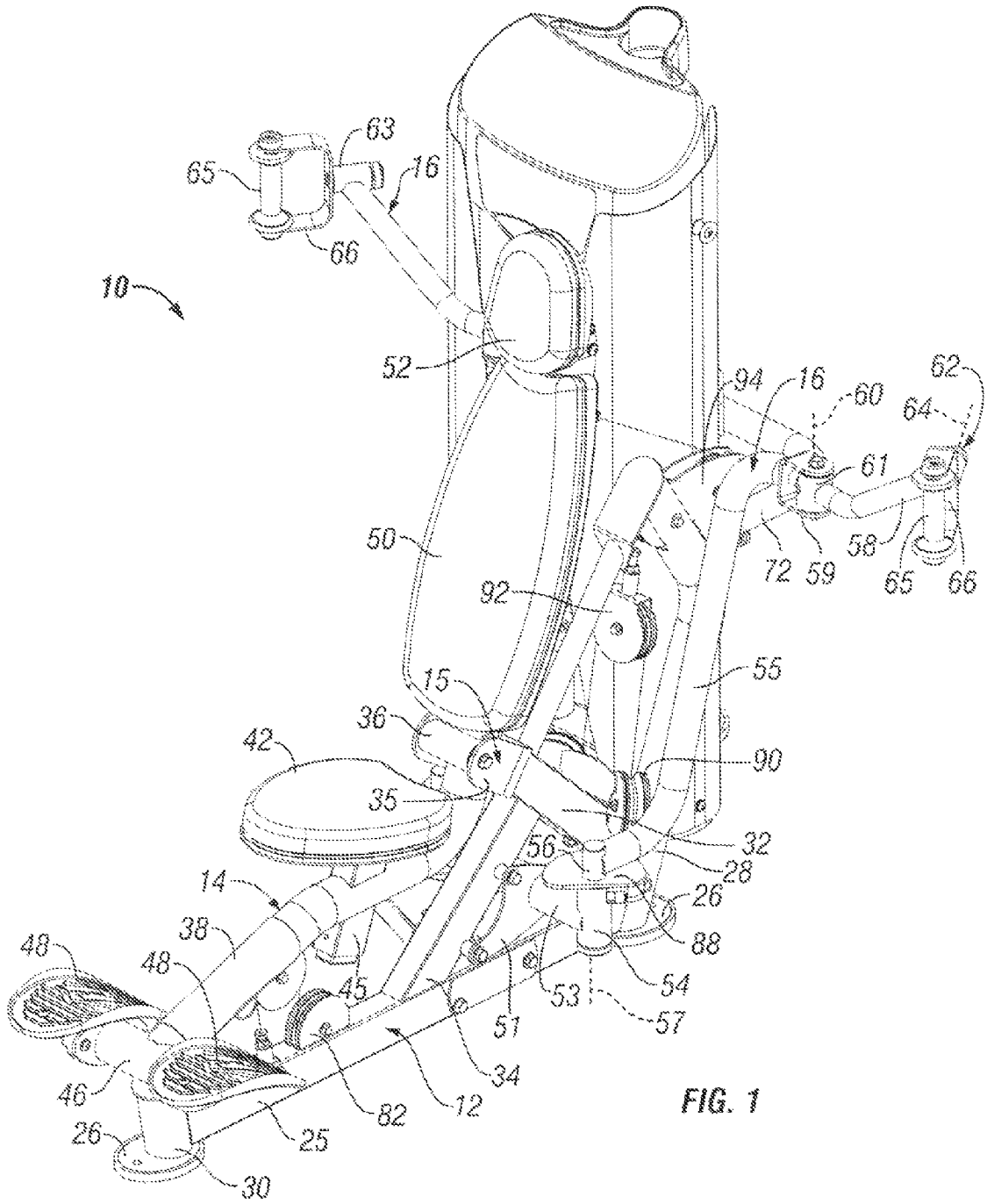
FIG. 1 is a front perspective view of a pectoral or pec fly exercise machine according to a first embodiment, with the machine in a start position for performing a pec fly exercise.
Figure 2:
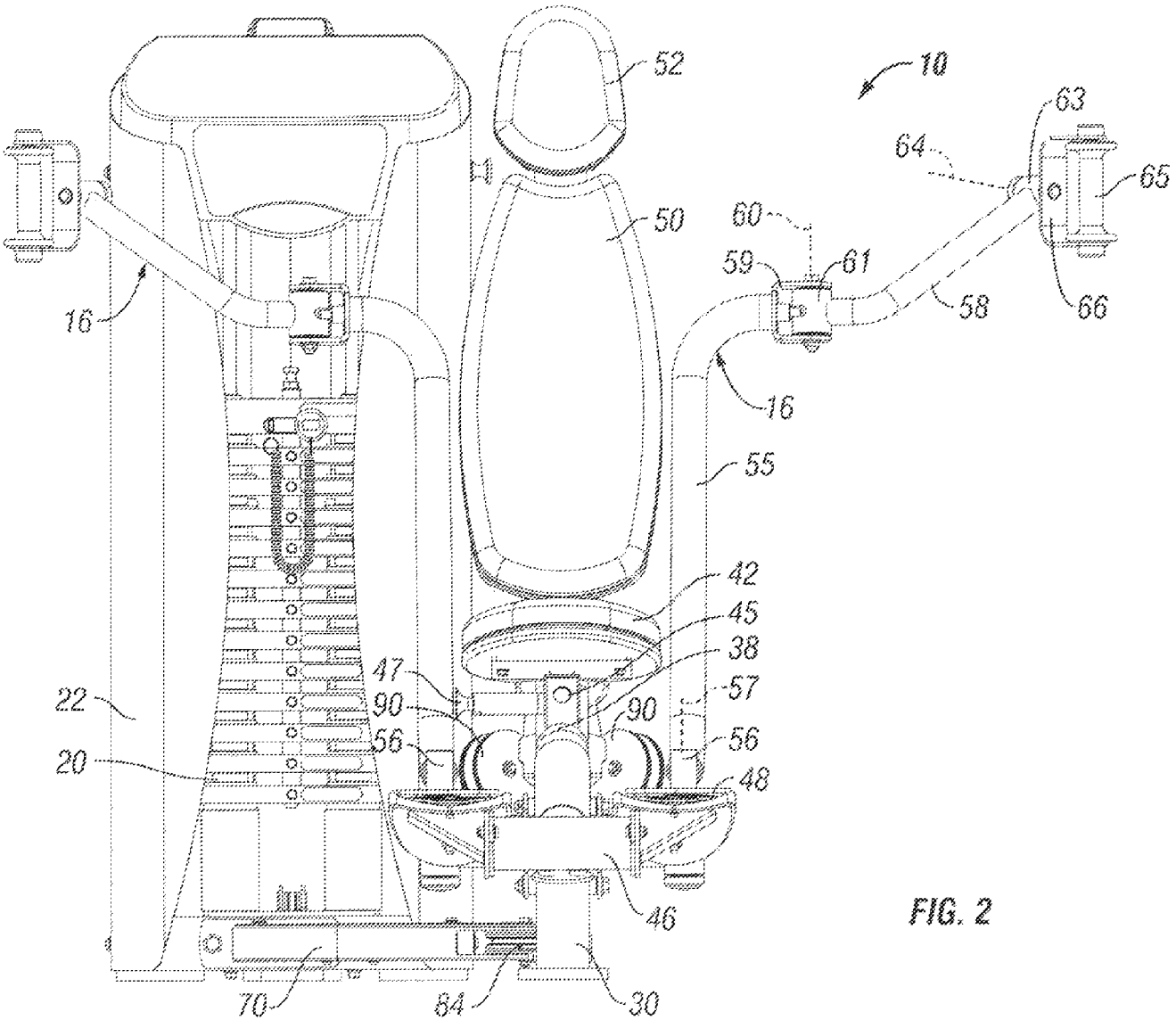
FIG. 2 is a front elevation view of the machine of FIG. 1.

The main frame 12 has a base section or strut 25 having a ground-engaging pad or foot 26 at each end, a first or rear upright strut 28 at the rear end of base strut 25, and a relatively short upright post or stand-off 30 at a forward end of base strut 25. A forward end portion of the user support frame 14 rests on the upper end of post 30 in the start position of FIGS. 1 to 5, as best illustrated in FIGS. 1, 3 and 5. An upwardly inclined pivot support strut 32 extends forwardly at an angle from rear upright strut 28, and a second upwardly inclined support strut 34 extends rearward from the base strut 25 to meet the pivot support strut 32 adjacent its forward end. The user support pivot 15 comprises a pivot mount or bracket 35 which is mounted at the forward end of pivot support strut 32, and a pivot pin which extends between the ends of bracket 35 and is rotatably engaged in a pivot sleeve 36 mounted on a forward side of user support frame 14, as best seen in FIGS. 1 and 3. This defines a user support pivot axis 37 (FIG. 5) located generally behind the user's hips and beneath the user's upper torso when seated on the user support. A vertical gravitational center line of the pivotal movement of the user support therefore extends through the user's body with parts of the user's body on both sides of the gravitational center line throughout an exercise movement.

User support frame 14 is generally L-shaped with a base portion 38 and an upright portion 40. A seat pad 42 is adjustably mounted on the base portion 38 via seat support post 44 which is telescopically engaged in an open upper end of a seat support tube 45 on the base portion. Seat support post 44 has a series of openings for releasable engagement with pull pin 47 to adjust the seat pad height based on user size and preference. The base portion 38 of the user support frame extends forward from the seat support tube 45 and a foot support bar 46 is transversely mounted at the forward end of base portion 38, with a foot support or foot rest 48 mounted at each end of bar 46 for engagement by a user's feet. Bar 46 engages the upper end of post or stand-off 30 in the rest or start position of FIGS. 1 to 5, 7 and 8. A back pad 50 and a head rest pad 52 are mounted on the upright portion 40 of the user support frame. As seen in FIGS. 1 and 5, the pivot sleeve 36 is mounted on the upright portion 40 of the user support frame just below the back pad 50 and to the rear of the seat pad 42.

The multi-part, articulating user engagement devices or exercise arm assemblies 16 are rotatably mounted via pivot mounts 54 at their first ends on the support strut 34 of the main frame, one on each side of the user support, as best illustrated in FIGS. 1, 2, 5, 7 and 8. Each exercise arm has a first elongate part or main arm 55 having a first end pivoted on the respective pivot mount or tube 54 via pivot shaft 56 for rotation about a first pivot axis 57 and a second end, and an elongated handle arm 58 which has a first end rotatably mounted on the second end of main arm 55 for rotation about second pivot axis 60. In the illustrated embodiment, the pivot connection between main arm 55 and handle arm 58 comprises a generally C shaped bracket 59 secured to the end of arm 55 with a pivot pin extending between the ends of bracket 59, and a sleeve 61 secured to the end of arm 58 and rotatably engaged on the pivot pin Inner and outer end stops on the bracket (not visible in the drawings) may be provided to limit the inward and outward movement of the arm 58 about pivot axis 60 to a predetermined angular range. A user-engaging grip 62 is rotatably mounted on the second end of handle arm 58 for rotation about a third pivot axis 64. The hand grip 62 comprises a grip member 65 rotatably mounted between the ends of a generally C-shaped mounting bracket 66, for additional adjustment of the user's hand position throughout an exercise. A pivot pin extends from bracket 66 to engage in pivot sleeve 63 secured to the end of arm 58, as illustrated in FIGS. 1, 7 and 8.

The pivot mounts or tubes 54 which rotatably support each exercise arm assembly are mounted on opposite sides of the angled support strut 34. Each pivot mount 54 is secured to the respective side of strut 34 by a generally triangular mounting plate or bracket 51 and a connecting rod 53 which extends transversely through plates 51 and connects to both pivot mounts 54, as best illustrated in FIGS. 1 and 4. This provides a stable pivot support with the desired horizontal offset between the strut 34 and pivot mounts. The pivotal connection between each handle arm and the respective main arm allows the handles to rotate inwardly and outwardly relative to their attachment to the main arms, as indicated by arrows A in FIG. 8, so that the combined movement of the main and handle parts of the exercise arm about pivot axes 57 and 60 results in forward and rearward elliptical travel paths. Movement of the main arm is resisted due to its cable and pulley linkage to the user support and weight stack, but the handle arms rotate freely about pivot axis 60 between the inner and outer end stops.

In this embodiment, the first pivot axis is generally vertical while the second pivot axis 60 is skewed at an angle to the vertical, as seen in FIG. 5. The angle of pivot axis 60 is such that handle arms 58 tend to fall outwardly to the outer rest or exercise ready position illustrated in FIG. 1 when released, as determined by the outermost stop on pivot bracket 59. Alternatively, pivot axis 57 may be skewed at an angle to produce the same effect. The third or hand grip pivot axis 64 is horizontal or close to horizontal and extends generally transverse to the first pivot axis in one embodiment, but may be skewed at an angle to the horizontal direction in other embodiments. Pivot axis 64 is angled in a generally outward direction from the rear to the front of the frame when in the start position, as illustrated in FIG. 7. As noted above, although rotation of main arms 55 about their pivot axes 57 is resisted by the cable and pulley linked to the user support, which in turn is linked to the weight stack, the rotation of handle arms 58 between the end stops is free and unrestricted. In the illustrated embodiment, all three pivot axes are non-parallel and non-perpendicular, although the third pivot axis is close to perpendicular to the first pivot axis. In another embodiment, the first and second pivot axes may be vertical and parallel while the third pivot axis is perpendicular to the first and second pivot axes.

The weight stack housing 22 is positioned to the rear of the stationary frame 12 and offset to one side of the user support frame 14, as illustrated in FIGS. 1 and 7. Housing 22 is connected to the main frame by a guide tube or channel member 70 extending from the base strut 25 to a lower end of the housing 22 adjacent weight stack 20, and by a connecting strut 72 which extends between a mounting plate 74 on the rear side of rear upright 28 and a mounting plate 75 on the rear side of weight stack housing 22, as seen in FIG. 7. In one cabling option, as illustrated in FIGS. 5 and 6, the user support frame 14 is linked to the weight stack 20 by a cable and pulley assembly 24 comprising a cable or line 76 having an anchor 77 at one end secured at an anchor position 78 under a forward end of the user support frame adjacent the foot support 48. The cable extends from the anchor position around a pulley 80 on the underside of base portion 38 of the user support frame, around a pulley 82 on base strut 25 of the stationary frame, and then around a series of pulleys 84 (see FIGS. 2 and 3) in the guide tube 70, after which the cable extends along guide tube 70 and around additional pulleys (not visible in the drawings) as needed until it attaches to the top of the weight stack. The cable and pulley linkage may include one or more cables in the path along guide member 70 and through housing 22 to the top of the weight stack.

A second anchor position 85 for the anchor 77 of load bearing cable 76 may be provided on the base strut 25 of the stationary frame, spaced forwardly from pulley 82, as indicated in FIGS. 1 and 3 as well as FIGS. 9 and 10. FIGS. 9 and 10 illustrate the alternative cabling option to the weight stack in which the anchor 77 is bolted to anchor position 85 on the base strut, rather than anchor position 78 on the base portion of the pivoting user support frame. This option results in increased resistance felt by the user, i.e. a harder exercise. In the harder cabling option of FIGS. 9 and 10, cable 76 extends from anchor position 85 on the base strut 25 of the stationary frame around pulley 80 on the underside of the base portion 38 of the user support frame. The cable path is identical to that of FIG. 5 from this point. The exercise machine as illustrated in FIGS. 5 and 6 and in FIGS. 9 and 10 is identical apart from the different anchor position for cable 76, and like reference numbers have been used for like parts as appropriate. In one embodiment, both anchor positions 78 and 85 are provided on the machine so that an installer may select an easier or a harder exercise by moving the cable anchor between anchor position 78 and anchor position 85.

The cable and pulley linkage 18 between the two exercise arm assemblies 16 and the user support frame 14 is best illustrated in FIGS. 1, 3, 5 and 7, with the cables omitted in FIGS. 1, 3 and 7 for clarity and added in FIG. 5. The cable and pulley linkage 18 is identical in FIGS. 5 and 6 and FIGS. 9 and 10, and like reference numbers have been used for like parts as appropriate. Linkage 18 includes a resistance cam or plate 88 mounted on each pivot shaft 56, a pair of angled, oppositely directed pulleys 90 on opposite sides of the pivot support strut 32 of the main frame adjacent the respective cams 88, and a floating single pulley 92 suspended from double pulleys 98 rotatably mounted in double pulley housing 94 mounted at the upper end of the upright strut 28. A first cable or flexible link 95 (FIG. 5) has a first end attached to an anchor 93 on cam 88 of a first exercise arm, and extends over the adjacent angled pulley 90, around the floating pulley 92, and around the second angled pulley 90, before attaching to the cam 88 of the second exercise arm. A second cable or flexible link 96 extends from floating pulley 92 around double pulleys 98 before connecting to a cable anchor 99 on the rear of the upright portion 40 of the user support frame. This is the connecting link between the user support and exercise arm, and ensures that forward rotational movement of one or both exercise arms results in rearward rotational movement of the user support.

In order to perform a pec fly exercise, a user sits on the seat pad 42 with their feet on foot rests 48 and leans against back pad 50 and head support 52. They then grip the hand grips 65 on each exercise arm assembly 16 with the arms in the start position of FIGS. 1 to 5, 7 and 9. In this position, the user's arms are extended to the side, with the elbows bent and the hands gripping the hand grips 65 slightly below shoulder height, and the user's upper body is oriented in a slightly rearward reclined orientation as determined by the angle of the back rest 50 as seen in FIG. 5 or 9. Thus, in the start position illustrated in FIGS. 1 to 5 and 7, the exercise arms extend out to the sides of the user support with the hand grips at a location corresponding to the appropriate hand and arm starting position for a free weight pectoral fly exercise. Individual users can adjust the height of seat pad 42 so that they are appropriately positioned to grip the handles at just below shoulder height. In the start position, the foot rest cross bar 46 is seated on stand off or post 30. The user then extends their arms forward and inward in an arc as indicated by the arrows A in FIG. 8. The connecting linkage 18 between the arm assemblies and the user support frame simultaneously rocks the user support frame rearwards into the end position of FIG. 6 or 10, while the cable and pulley linkage between the user support frame and weight stack simultaneously pulls on the cable 76 to lift the selected amount of weight in weight stack 20.

Figure 5A:
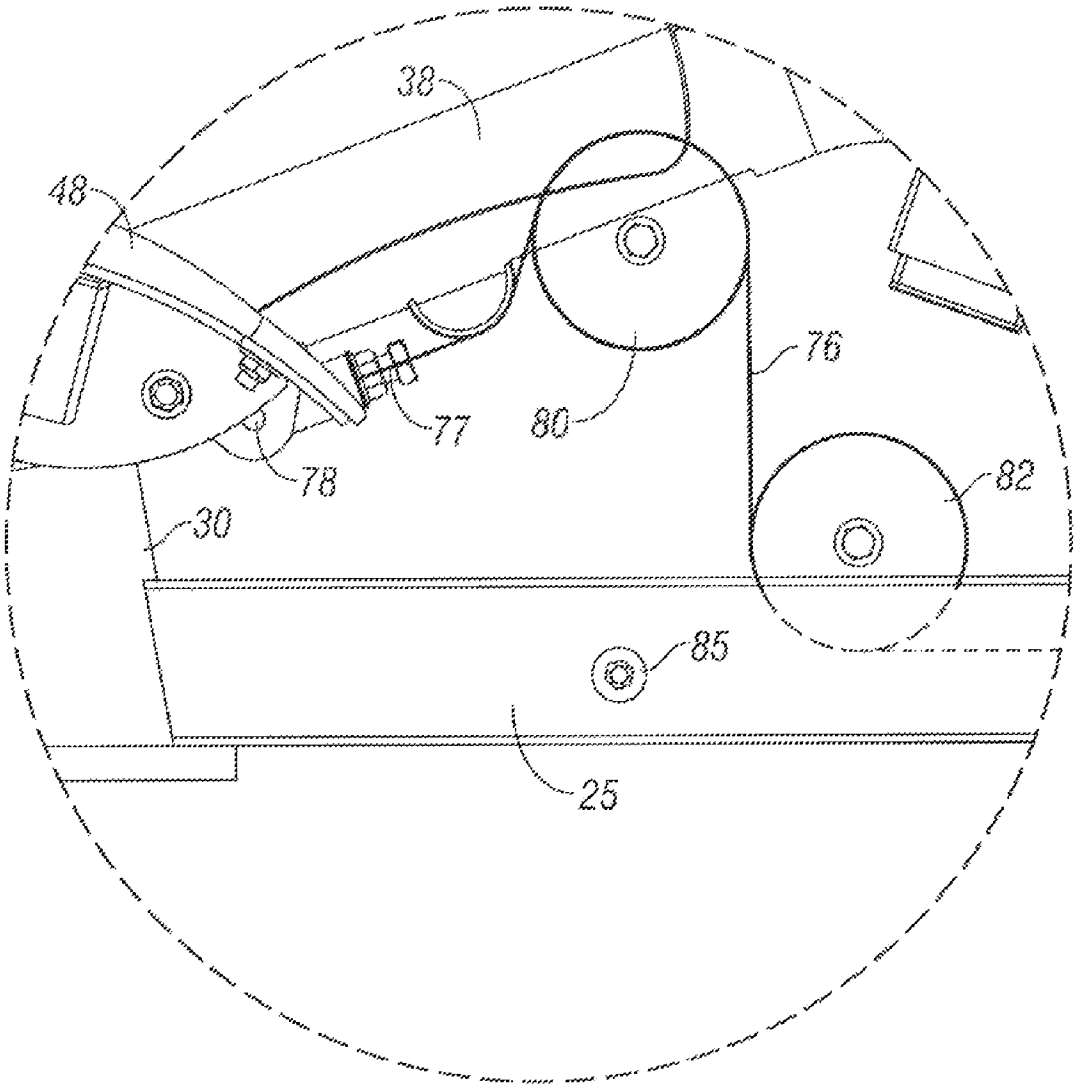
FIG. 5A is an enlarged side elevation view of the circled portion of FIG. 5, showing cable connection from the user support frame to the main frame in the exercise start position.
Figure 9A:
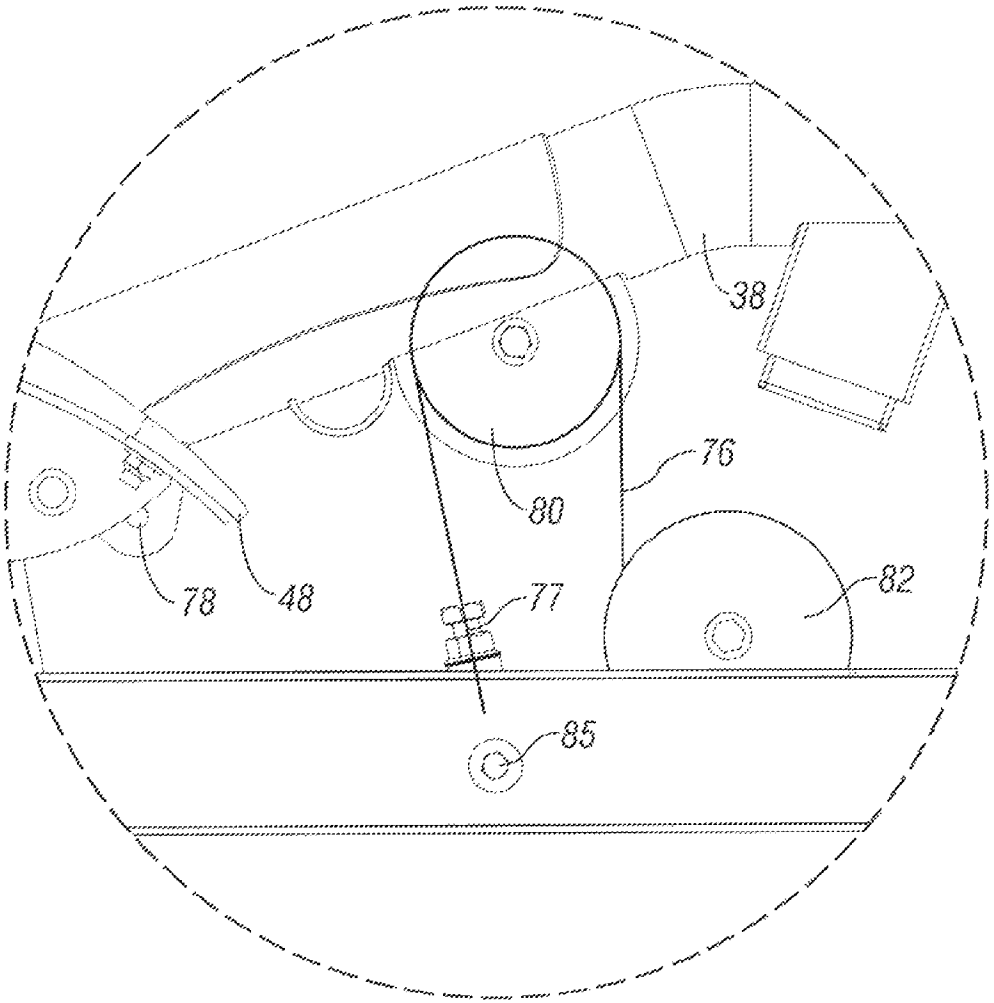
FIG. 9A is an enlarged side elevation view of the circled portion of FIG. 9, showing the cable path between the user support frame and the main frame in the exercise start position.

FIGS. 5A and 6A illustrate the amount of cable pull needed to move from the start to the end position of a pec fly exercise when the easy cabling option of FIGS. 5 and 6 is used, in which the anchor 77 of load bearing cable 76 is connected to anchor point 78 on the user support frame. It can be seen that one length of cable is pulled in this version. FIGS. 9A and 10A illustrate the amount of cable pull needed to move from the start to the end position when the hard cabling option of FIGS. 9 and 10 is used, in which the anchor 77 of load bearing cable 76 is bolted to anchor point 85 on the base strut 25 of the main frame. By comparing FIG. 10A with FIG. 6A, it can be seen that two lengths of cable are pulled in the harder cabling option, i.e. double the amount of cable pull in FIG. 6A. This increases the travel to the weight stack and increases the resistance felt by the user.

The combined movement of the exercise arms and the user support defines a straight fly exercise position at the start of the exercise (see handle and user support position of FIGS. 5 and 9) and then rotates into a decline fly exercise throughout the exercise movement, with the user's hands moving inward in a slightly arcing or elliptical path to the end position as indicated by the location of hand grips 65 in FIG. 8, and ending at a slightly lower position relative to the user's body than in the start position, as seen by comparing the hand grip positions in FIGS. 5 and 6 relative to the user support seat. Since this machine involves only straight or decline fly exercise throughout the movement, there is less shoulder muscle involvement than in some prior art machines, and only the mid and lower pectoral muscles are involved, so that these muscles can be targeted more specifically. The start position of the user support and/or the exercise arm assembly may be modified in an alternative embodiment so that the entire exercise is a decline fly exercise, for specific targeting of lower pectoral muscles only. The three pivot axes 57, 60 and 64 of the articulating exercise arm assemblies help to produce a movement which is similar to the joint movement of the user's arms when performing a free weight pec fly exercise. Because of the multiple pivots on the articulating exercise arms, the user-engaging handles self-align to the movement of the user to provide a user-defined exercise motion. The rocking movement of the user support is achieved without changing the position of the user on the user support. Through out the entire "explosive" movement, the user is in a stabilized position with their feet and upper torso supported. This stabilized position provides a strict exercise movement by preventing or reducing the involvement of other muscle groups and focusing effort just on the mid and lower chest or pectoral muscles.

By linking movement of the user support to movement of the exercise arm and positioning the user support pivot so that the combined weight of the user support and user is distributed on both sides of the gravitational centerline, the user support provides a counter-balancing effect on the exercise arm as it moves and its weight is re-distributed. This slight re-distribution is gradual and continuous throughout the exercise motion and barely noticed by the user.

FIGS. 11 to 14 illustrate a pectoral fly exercise machine 100 according to a second embodiment, in which the articulating exercise arm assembly of the previous embodiment is replaced by a flexible cable linkage, as described in more detail below. This machine is similar to a chest press exercise machine as described in our co-pending U.S. patent application Ser. No. 11/846,437 entitled Chest Press Exercise Machine with Self-Aligning Pivoting User Support, which was filed on Aug. 28, 2007, and the contents of application Ser. No. 11/846,437 are incorporated herein by reference in their entirety. Exercise machine 100 is of similar structure to the chest press machine illustrated in FIGS. 9 and 10 of patent application Ser. No. 11/846,437 referenced above, and has a stationary main frame 102, a user support frame 104 pivotally mounted on the main frame, a user engagement assembly 105 linked to the user support frame, and an exercise resistance or weight stack 108 located at a forward end of the main frame 102.

Figure 11:
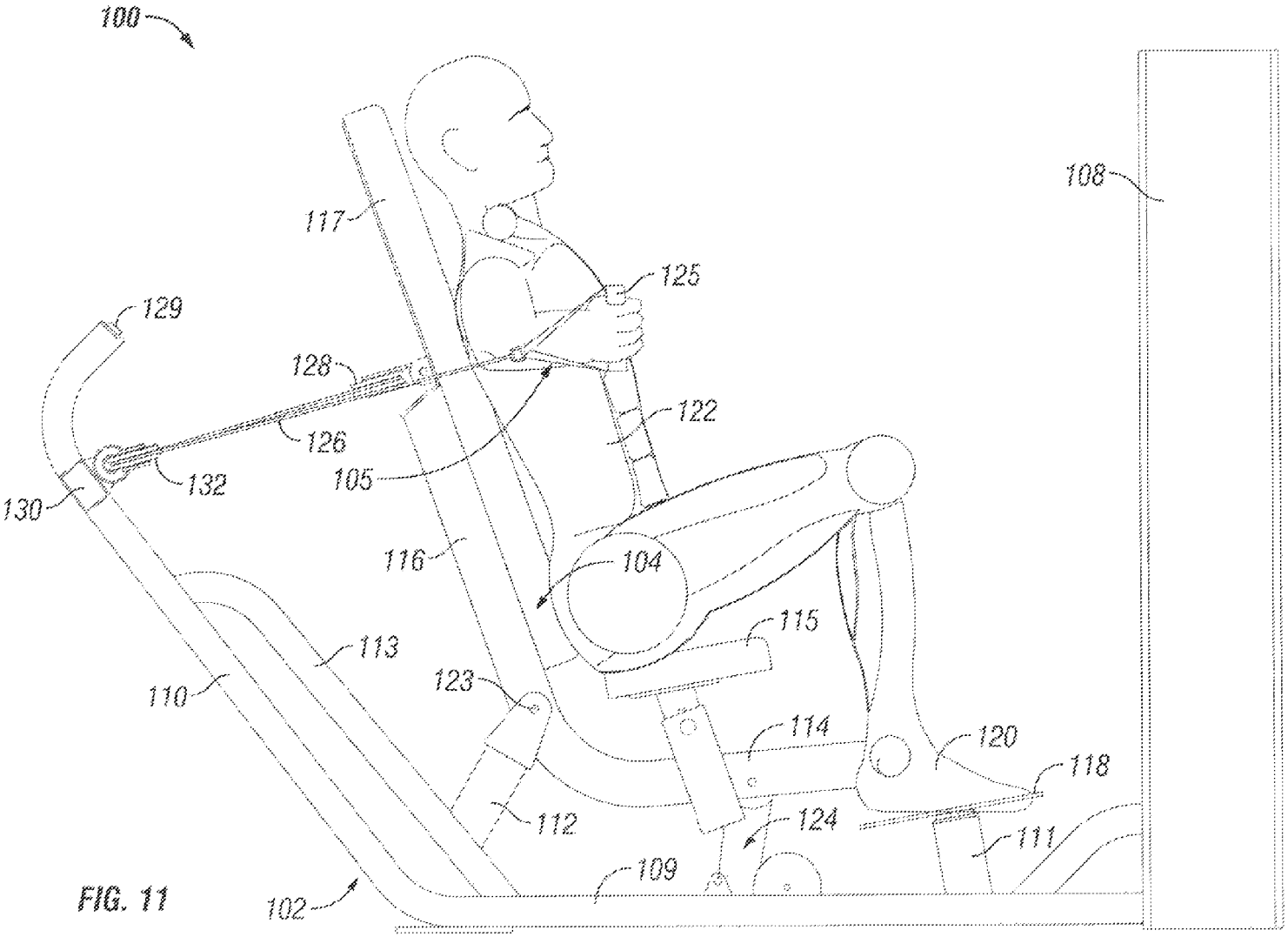
FIG. 11 is a side elevation view of a pectoral fly exercise machine according to a second embodiment, illustrating the start position for a pec fly exercise.

The main frame 102 has a base section 109 and a rear upright 110 which is inclined rearwardly from the base section. A stand off post 111 extends upwardly from the base section 109 for supporting the user support frame in a rest or start position, as indicated in FIG. 11. A user support pivot mount 112 extends forwardly from a pivot mount strut 113 which has one end secured to the rear upright 110 and the other end secured to base section 109.

The user support frame 104 is generally L-shaped with a base 114 on which a seat pad 115 is adjustably mounted in a similar manner to seat pad 42 of the previous embodiment, and an upright 116 on which a back pad 117 is mounted. A foot rest 118 is secured to the forward end of base 114 and supports the feet 120 of a user 122 seated on the user support as in FIG. 11. Cable and pulley linkage 124 links the base 114 of the user support frame to the weight stack 108 in order to provide an adjustable amount of exercise resistance. The user support frame is pivotally mounted on the pivot mounting post 112 for rotation about user support pivot axis 123 which is located on the upright 116 beneath the back pad 117.

Figure 12:
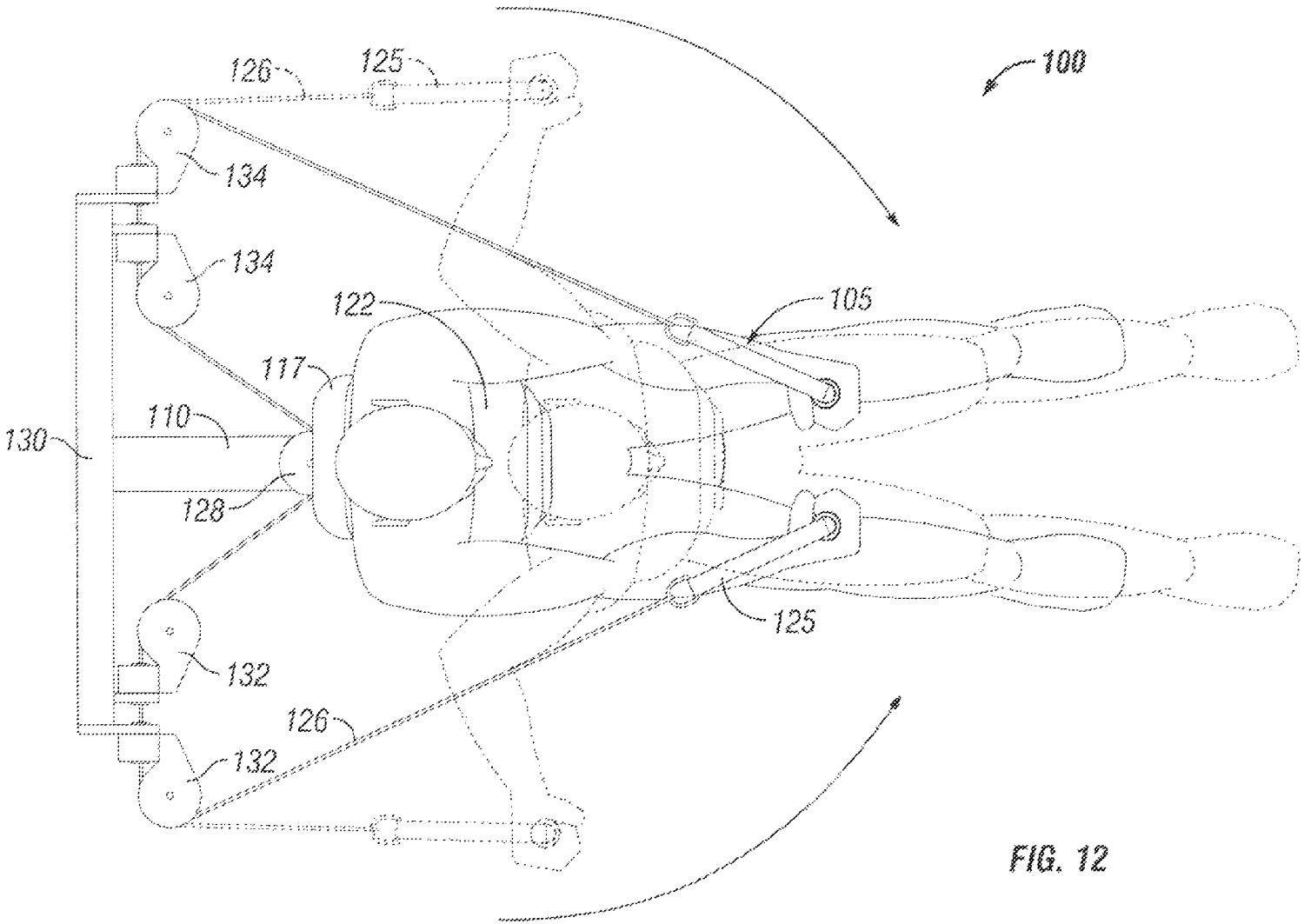
FIG. 12 is a top plan view of the machine of FIG. 11 illustrating start and finish positions for a pec fly exercise.
Figure 13:
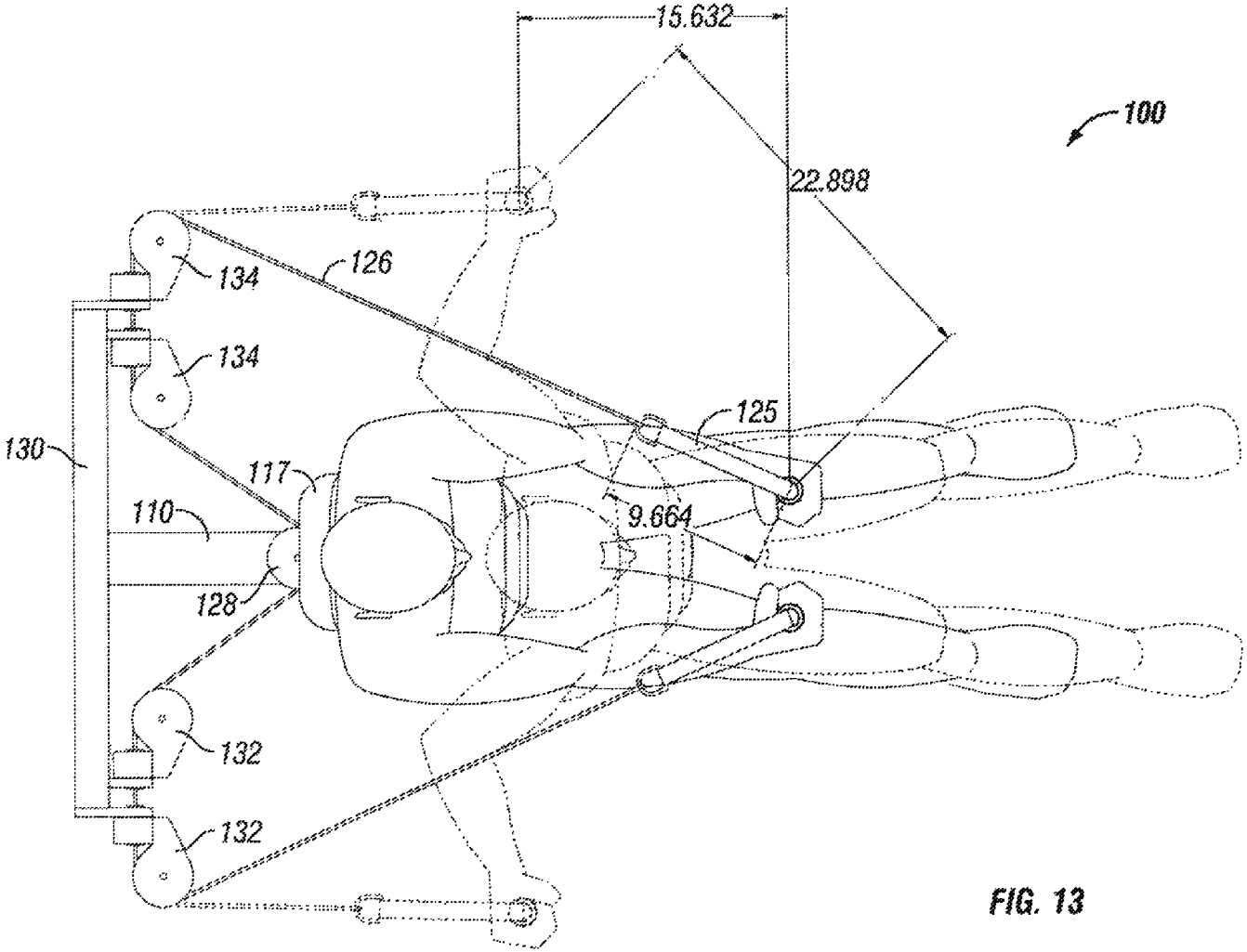
FIG. 13 is a top plan view similar to FIG. 12 illustrating some dimensions in inches.
Figure 14:
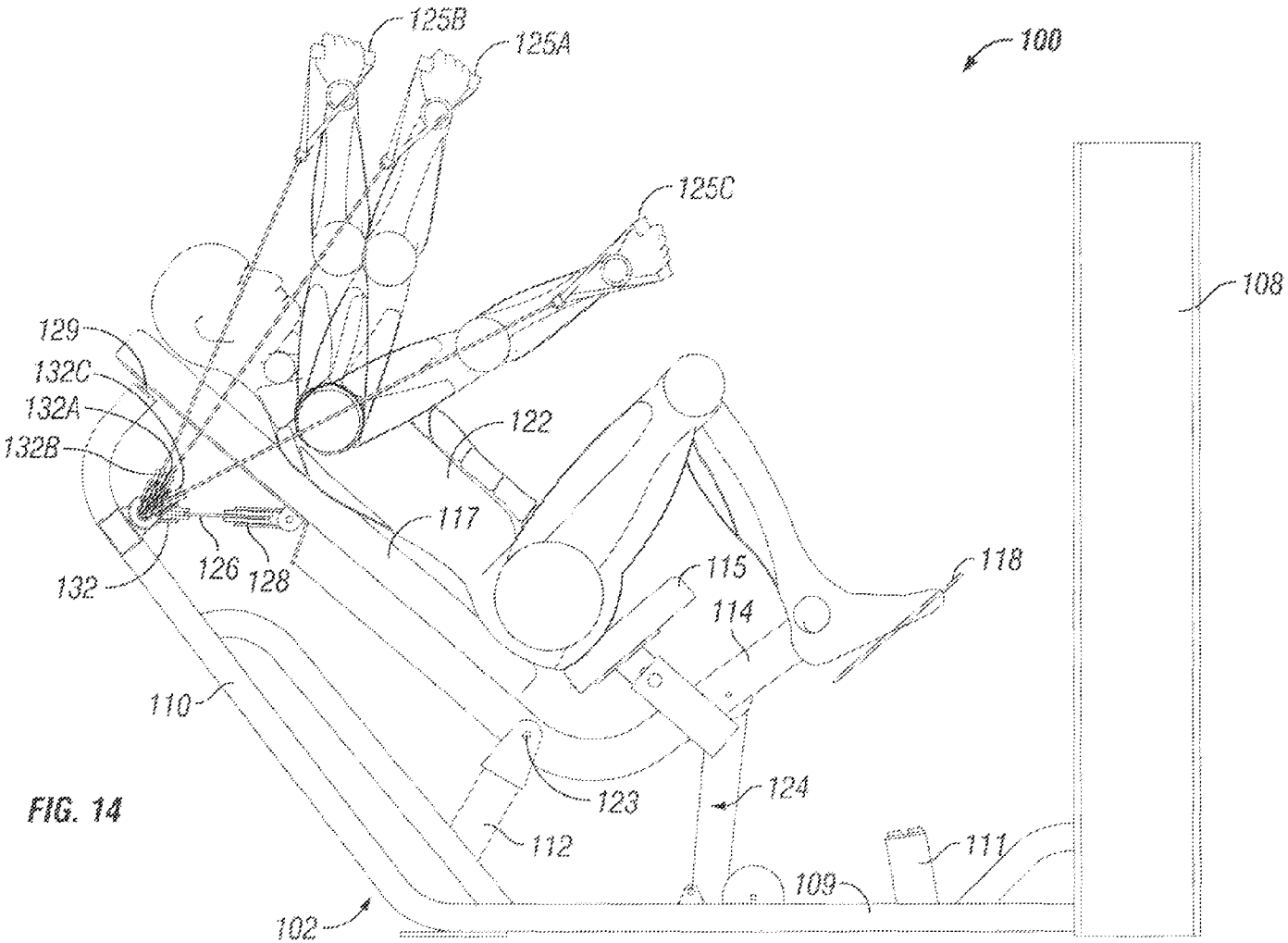
FIG. 14 is a side elevation view of the machine of FIGS. 11 and 12 illustrating alternative, user controlled finish positions for a pec fly exercise.

As in the embodiment of FIGS. 9 and 10 of U.S. application Ser. No. 11/846,437 referenced above, the user engagement assembly 105 in this embodiment comprises a pair of strap handles 125 linked to the rear upright 110 by a flexible cable or line 126 which is also connected to the user support frame by means of a swiveling pulley 128 pivotally mounted on the back of the backrest or upright section 116 of the user support frame. The swiveling pulley 128 forms the connecting link between the user engagement device and the user support. As best illustrated in FIG. 12, a cross tube 130 is mounted transversely in a T-configuration adjacent the upper end of the rear upright 110 of the main frame. Dual pairs 132, 134 of swiveling pulleys are pivotally mounted at or adjacent opposite ends of cross tube 130. All the swiveling pulleys 128, 132, 134 are free pivoting and capable of independent movement. Opposite ends of cable or flexible line 126 are secured to respective strap handles 125, and the cable extends from one handle around a first pair 132 of swiveling pulleys on cross tube 130, then around the swiveling pulley 128 on the upright section of the user support frame, and then around the second pair of swiveling pulleys 134 up to the second handle 125, as illustrated in FIGS. 12 and 13. Although the cable is attached to flexible strap handles in the illustrated embodiment, alternative types of handles or hand grips may be secured to the ends of cable 126 in alternative embodiments. The inner pulley of each pair of pulleys 132, 134 tracks the movement of the central, swiveling pulley, while the outer pulley of each pair tracks the movement of the handles, as illustrated in FIG. 14. This allows the user to determine the movement of their hands and arms in performing an exercise.

In co-pending application Ser. No. 11/846,437 referenced above, a similar machine was described for performing different types of chest press exercises. Since the flexible cable linkage to the user engaging handles essentially allows the user to determine the start and finish position for an exercise, whether chest press or pec fly, the flexible cable linkage illustrated in FIGS. 12 to 14 may be used to perform the different pec fly exercises illustrated in FIGS. 12 to 14 or to perform alternative chest press exercises as in prior application Ser. No. 11/846,437 referenced above.

In order to perform a selected pec fly exercise, the user sits on the user support with their back against back pad 117 and their feet resting on foot rest 118. In the start position of FIG. 11, the back pad or back rest is reclined slightly rearwards and the foot rest 118 engages the stand off post 111. The user then grips the handles 125 and moves their hands and arms into a pec fly start position as illustrated in FIG. 11, and in dotted outline in FIG. 12. In the start position, the arms are extended out to the side with the elbow bent forwards and the hands gripping the handles just below and forward from the shoulders. This is different from the start position for a chest press exercise as described in application Ser. No. 11/846,437 referenced above, where the elbows are bent downwards rather than raised out to the side and the hands are positioned closer to the user's body in the exercise start position. Thus, it can be seen that the user can easily choose to perform a pec fly exercise or a chest press exercise on machine 100. The user can also choose to finish the exercise with their hands at different elevations in order to perform different types of pec fly or chest press exercises. Assuming that the user starts the exercise in the pec fly start position of FIG. 11, which corresponds to the dotted line position of FIG. 12, they then push their hands forward and inward in a path indicated by the arrows in FIG. 12. The hands can be kept at the same general elevation relative to the user's body in order to simulate a straight fly exercise, with the handles ending in finish position 125A of FIG. 14. Alternatively, the hands can be elevated to forehead level with the handles at the finish position 125B of FIG. 14, simulating an incline fly exercise, or can be lowered to finish at abdominal level in the handle finish position 125C, simulating a decline fly exercise.

As the hands are extended forward and inward, pulling on cable 126, the user support frame is rocked rearward about user support pivot axis 123 into a more rearwardly reclined orientation, due to the swiveling pulley 128 which links cable 126 to the user support frame. In the finish position of FIG. 14, the rear upright of the user support frame rests against a stop or bumper pad 129 at the end of upright 110. At the same time, the base 114 of the user support frame is lifted upward, pulling the cable of cable and pulley linkage 124 against the resistance supplied by weight stack 108. The weight stack may be replaced by other types of exercise resistance in alternative embodiments, such as weight plates mounted on the user support frame.

Because the user support moves in conjunction with the user engaging handles, the arcuate path of the user's hands relative to the user support is reduced, resulting in a more natural feeling exercise movement which more accurately replicates the movement found in the corresponding free weight pec fly exercise. FIG. 13 illustrates one example of the amount of movement of the handles 125 between the start and finish position. In this embodiment, the forward movement of the handles is around 15 to 16 inches, while the arcuate path traveled may be of the order of 22 to 24 inches. The length of the strap handles 125 is around 9 to 10 inches in this embodiment. However, other dimensions may be used in alternative embodiments and the distance moved by the user's hands may vary in other embodiments based on the user's arm length.

Figure 15:
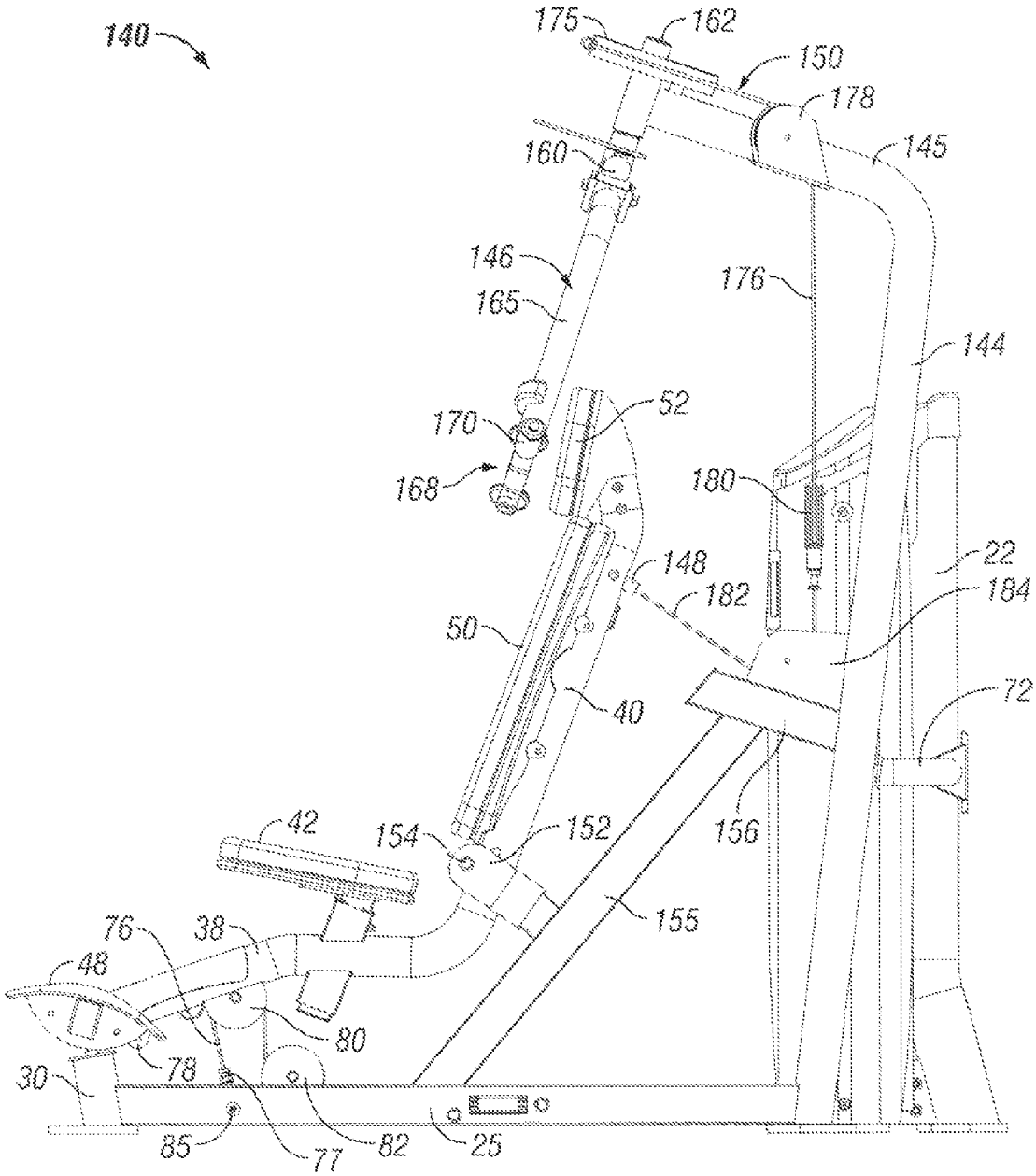
FIG. 15 is a side elevation view of a pec fly exercise machine according to a third embodiment, illustrating an exercise start position.
Figure 16:
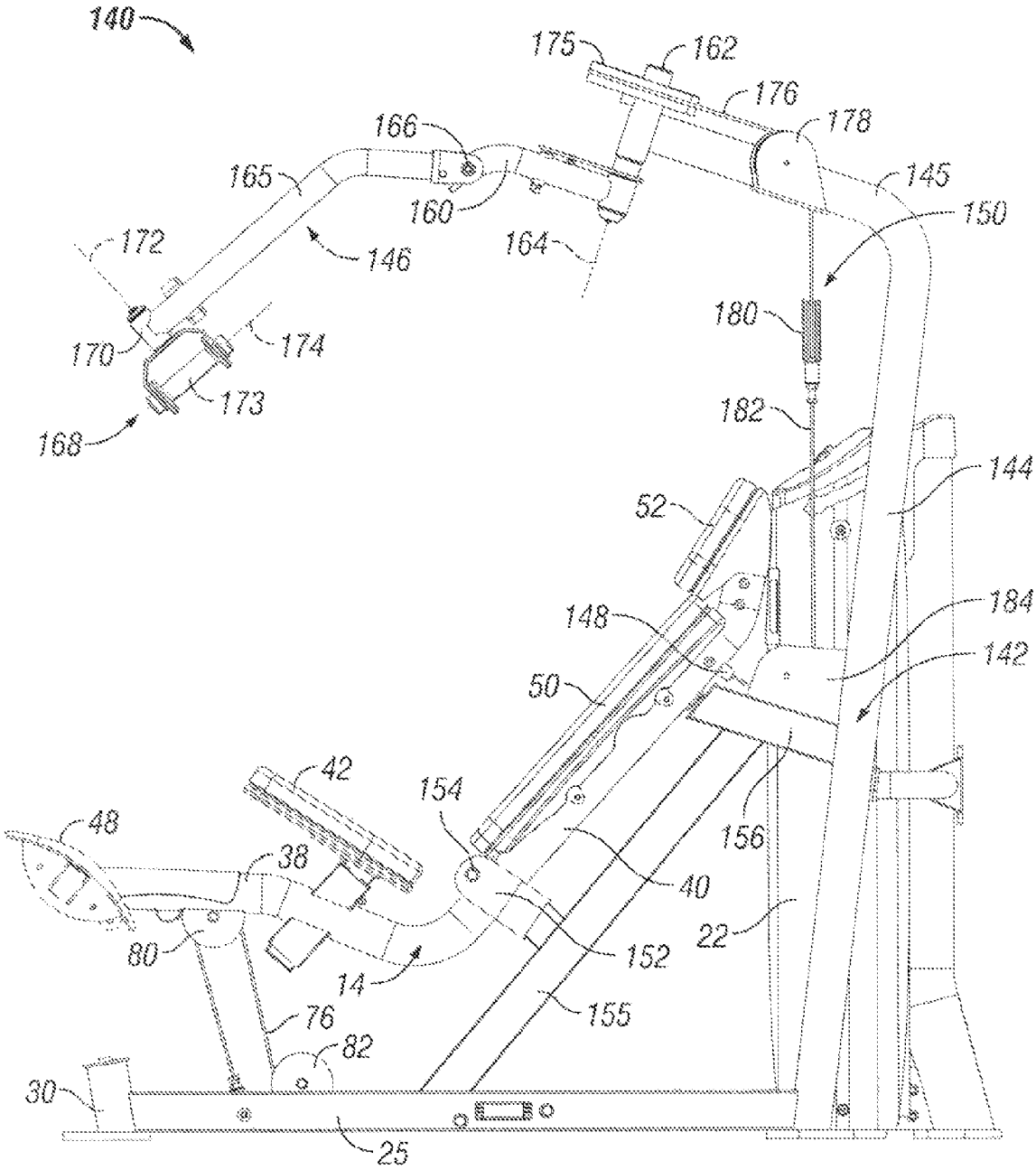
FIG. 16 is a side elevation view similar to FIG. 15, but illustrating an exercise finish position.

FIGS. 15 and 16 illustrate a modified pec fly exercise machine 140 according to a third embodiment. This embodiment has an exercise arm assembly which is pivoted above the user support, rather than below or to the rear of the user support as in the previous embodiments. Some parts of the machine 140 are identical to corresponding parts of the first embodiment, and like reference numbers have been used for like parts as appropriate. FIG. 15 illustrates the machine 140 in a start position for a pec fly exercise, while FIG. 16 illustrates an end or finish position for the exercise.

The machine 140 has a stationary frame 142 on which a user support frame 14 identical to that of the first embodiment is pivotally mounted. Stationary or main frame 142 has a base strut 25 and forward post or stand off 30 as in the first embodiment, but has a taller rear upright 144 than the first embodiment. Rear upright 144 extends upwardly above the user support and has an upper, forwardly projecting portion 145. An exercise arm assembly 146 is suspended from the forward end of upper portion 145, as explained in more detail below. Exercise arm assembly 146 is linked to an anchor 148 on the rear upright 40 of the user support frame by a cable and pulley linkage 150 so that movement of the exercise arms simultaneously rotates the user support from the start position of FIG. 14, which is at a slight rearward inclination, to the more reclined end position of FIG. 15.

The user support frame 14 is pivotally mounted on pivot mount or bracket 152 for rotation about user support pivot axis 154. Pivot mount 152 is secured to an inclined strut 155 extending between the base 25 and a stand off post or strut 156 on the rear upright 144 of the main frame.

A load bearing cable and pulley linkage identical to the linkage described above in connection with FIGS. 1 to 10 links the user support frame 14 to a weight stack in weight stack housing 22 which is secured to the main frame. FIGS. 15 and 16 illustrate the anchor 77 at the end of load bearing cable 76 attached to anchor point 85 on the base strut 25, which is the same as the hard cabling option illustrated in FIGS. 9 and 10 of the first embodiment. However, cable 76 may alternatively be secured to an anchor point on the base 38 of the user support frame, using the same cabling option as illustrated in FIGS. 5 and 6, for an easier exercise with less cable pull and thus less resistance to movement of the user support frame.

Exercise arm assembly 146 may be similar to the overhead exercise arm assembly described in U.S. Pat. No. 6,579,213 of Webber et al., the contents of which are incorporated herein by reference in their entirety. However, unlike the exercise arm assembly described in that patent which is linked to an exercise resistance, the exercise arm assembly 146 is linked to the user support frame 14 so that movement of the exercise arm assembly in a pec fly exercise simultaneously moves the user support frame from the start position of FIG. 15 to the end position of FIG. 16. In this embodiment, left and right articulating exercise arms are provided on each side of the user support frame, with each exercise arm comprising a main arm 160 which is pivoted to the forward end of the upper portion 145 of the stationary frame via pivot pin 162 which rotates about a first pivot axis 164, a swing arm 165 which is pivoted to the main arm for rotation about a second pivot axis 166, and a handle assembly 168 having a pivot pin rotatably engaged in pivot sleeve 170 at the end of swing arm 165 for rotation about third pivot axis 172. Handle assembly 168 also has a rotatably mounted grip 173 defining a fourth pivot axis 174.

As noted above, movement of the exercise arms is linked to the user support frame via cable and pulley linkage 150. As seen in FIGS. 15 and 16 for the left hand exercise arm, exercise arm pivot pin 162 is connected to a cam plate 175 which in turn is linked to an end of a cable 176. The linkage for the right hand exercise arm also includes a pivot pin 162 connected to a second cam plate 175 which is not visible in the drawings. First and second upper pulleys 178 are associated with the respective exercise arms. Cable 176 extends from one cam plate 175 around a first upper pulley 178, then around floating pulley 180 and back up to the second upper pulley 178 and cam plate 175 which is connected to the other exercise arm pivot pin 162. A second cable 182 extends from floating pulley 180 around a pulley mounted in pulley housing 184 on support post 156, and then connects to the anchor 148. Thus, movement of one or both articulating exercise arms will result in pivoting of the user support about its pivot axis 154.

In order to perform a pec fly exercise, a user first sits on seat pad 42 with the user support frame in the start position of FIG. 14, with their feet resting on foot rest or foot pads 48. They then grip the hand grips 173 with their arms and hands in a position equivalent to that shown in FIGS. 11 and 12 of the previous embodiment, i.e. the upper arms extending out to the side and slightly rearward and the elbows bent outwards with the hands spaced outwardly from the user's body and gripping the hand grips at a location just below and forward of the shoulders. The hands are then pushed forward and inward in an arcuate path similar to that shown by the arrows in FIG. 12 of the previous embodiment, with the exercise arms articulating about the various pivot axes to allow the desired joint motion to take place. This movement corresponds to a straight pectoral fly exercise with the hands at approximately the same height relative to the user in the start and end positions.

As the exercise arms are rotated forward, the pivot pin and attached cam plate 175 also rotates, pulling on cable 176 and thus lifting the floating pulley 180 from the position of FIG. 15 to that of FIG. 16. This in turn pulls on cable 182 to rotate the user support frame rearward about pivot axis 154 until the back rest engages stand off or support post 156 as seen in FIG. 16, which defines the end position for the exercise movement. Movement of the user support frame is resisted by the cable and pulley assembly which links the base 38 of the user support frame to the weight stack in housing 22, as in the first embodiment.

Figure 19:
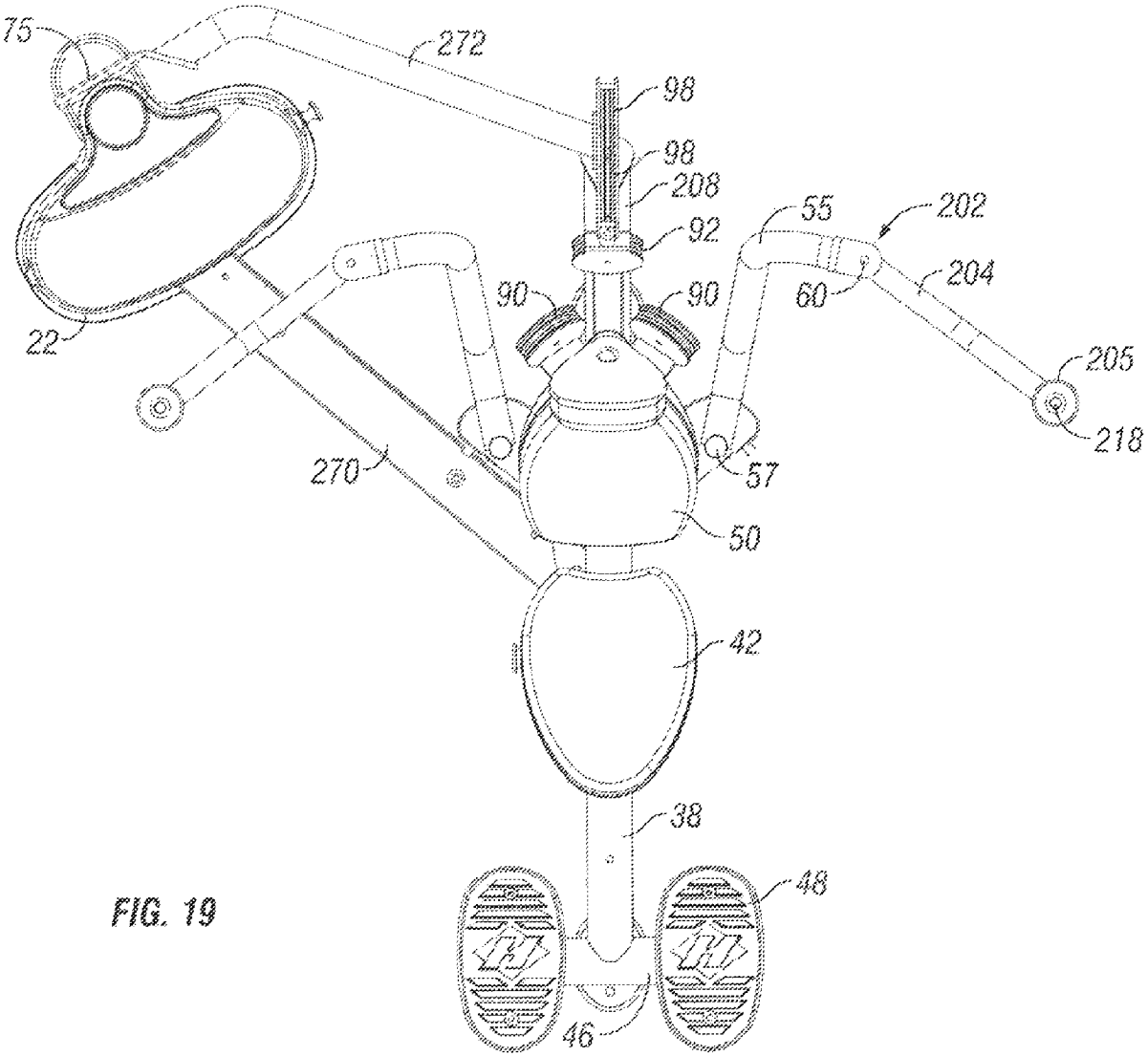
FIG. 19 is a top plan view of the machine of FIGS. 17 and 18 in the exercise start position.
Figure 20:
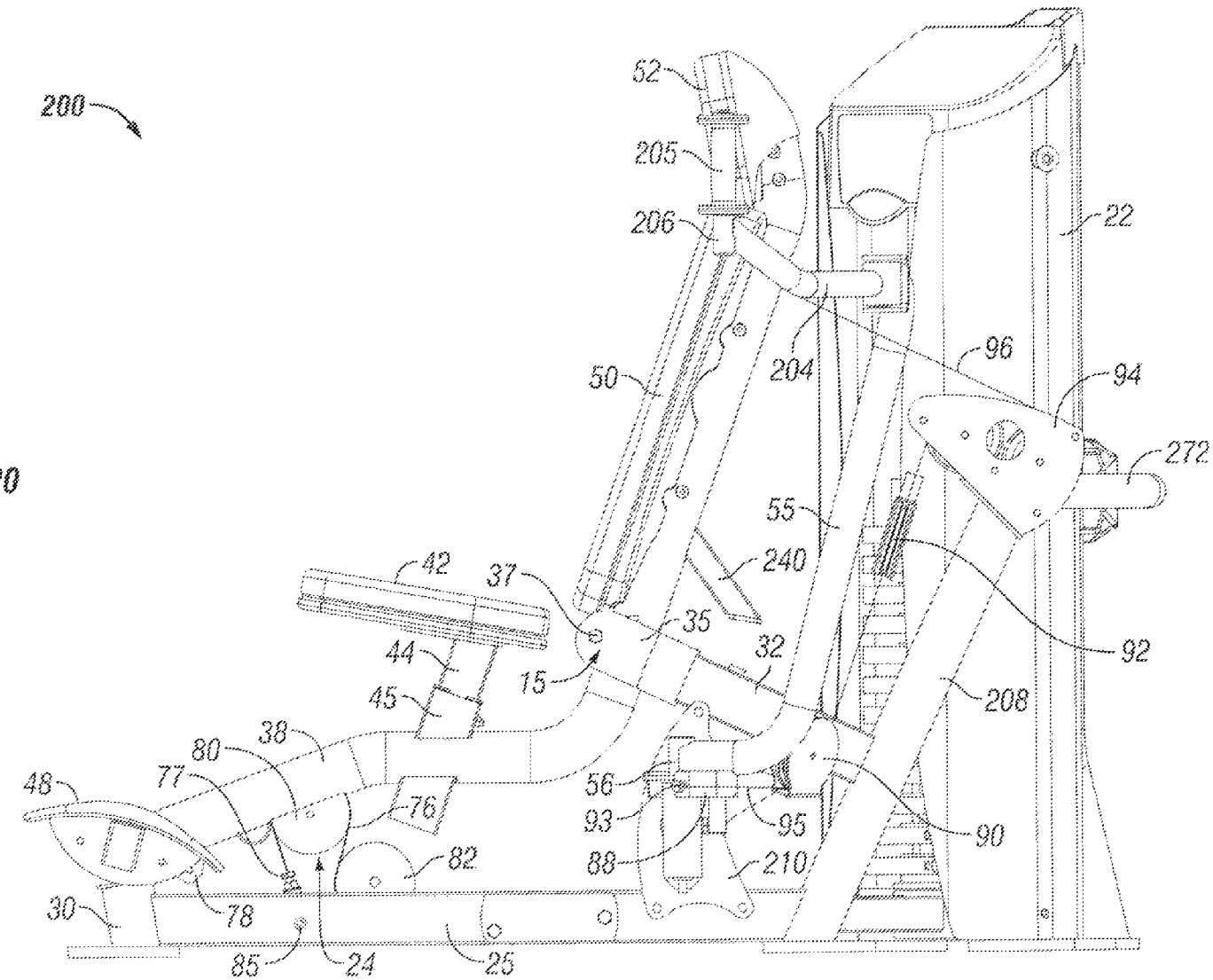
FIG. 20 is a side elevation view of the machine of FIGS. 17 to 19 in the exercise start position.
Figure 21:
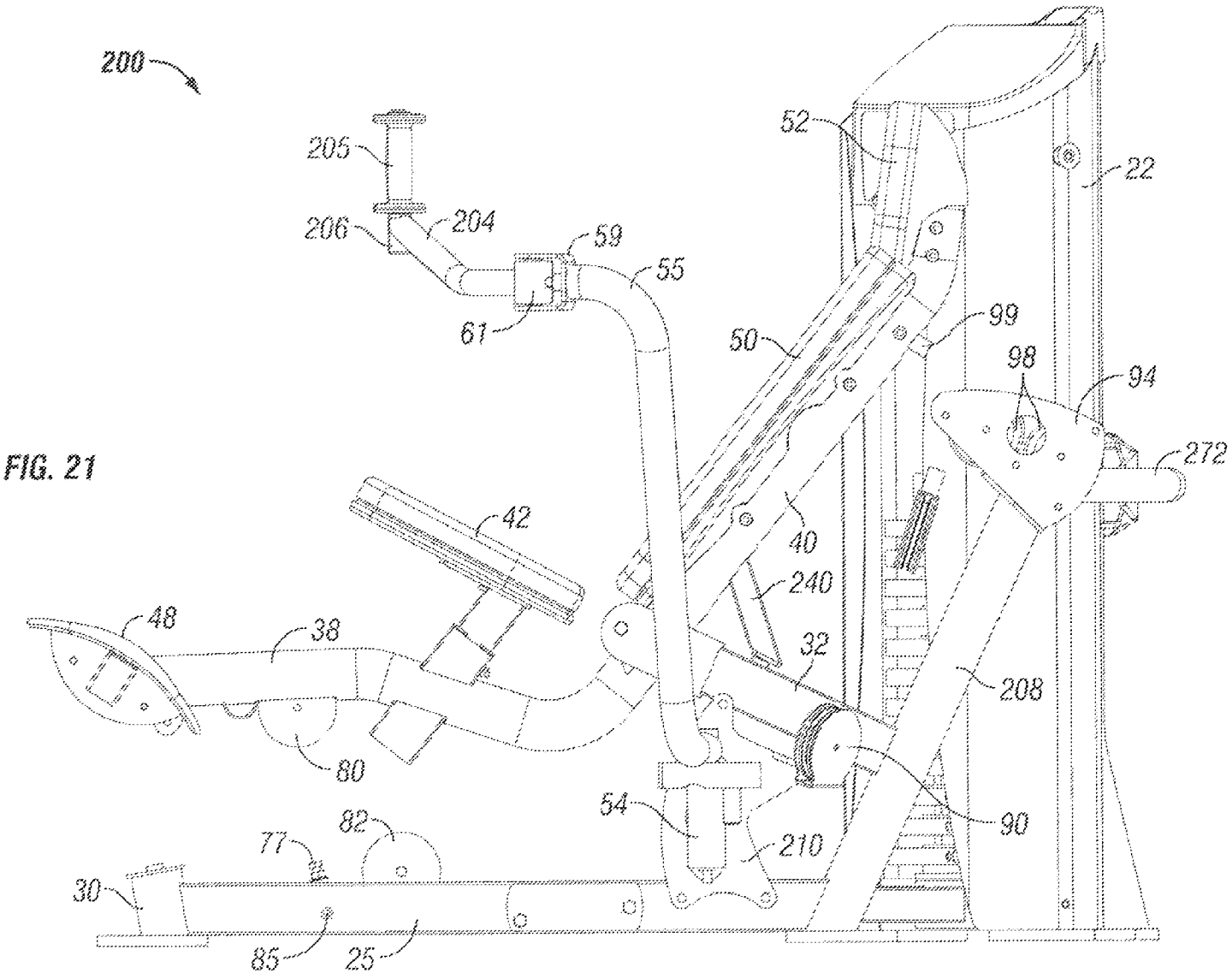
FIG. 21 is a side elevation view similar to FIG. 20 but illustrating the machine in an exercise finish position.

FIGS. 17 to 21 illustrate a pec fly exercise machine 200 according to another embodiment, with FIGS. 17 to 20 illustrating the machine in an exercise start position and FIG. 21 illustrates an end position for a pec fly exercise. This embodiment has modified articulating exercise arms 202 but is otherwise identical to the first embodiment, and like reference numbers are used for like parts as appropriate. The articulating exercise arms 202 in this embodiment are similar to the exercise arms in the pectoral fly machine of FIGS. 25 to 28 of co-pending application Ser. No. 10/633,805 referenced above, and have three parallel pivot axes rather than an offset, non-parallel handle pivot axis as in FIGS. 1 to 10.

Machine 200 has a stationary main frame 12, a user support frame 14 pivotally mounted on the frame via a pivot mount 15, and a pair of multi-part, articulating exercise arms 202 pivotally mounted on the main frame and linked to the user support frame via a cable and pulley linkage similar or identical to the cable and pulley linkage of the first embodiment, so that movement of the exercise arm assembly results in pivoting movement of the user support. The user support 14 is linked to a weight stack 20 mounted in weight stack frame or housing 22 via a cable and pulley linkage 24. The cabling of each cable and pulley linkage is omitted in FIGS. 17 to 22 for clarity, but the cable paths are identical to those of FIGS. 1 to 10.

As in the first embodiment, the main frame 12 of machine 200 has a base section or strut 25, a first or rear upright strut 208 at the rear end of base strut 25, and a relatively short upright post or stand-off 30 at a forward end of base strut 25. Rear upright strut 208 is slightly different from the rear upright strut 28 of the first embodiment and is not bent forward at its upper end. A forward end portion of the user support frame 14 rests on the upper end of post 30 in the start position of FIGS. 17 to 20. A pivot support strut 32 extends forwardly at an angle from rear upright strut 208. The user support pivot 15 comprises a pivot mount or bracket 35 which is mounted at the forward end of pivot support strut 32, and a pivot pin which extends between the ends of bracket 35 and is rotatably engaged in a pivot sleeve 36 mounted on a forward side of user support frame 14. This defines a user support pivot axis 37 (FIG. 20) located generally behind the user's hips and beneath the user's upper torso when seated on the user support.

User support frame 14 is generally L-shaped with a base portion 38 and an upright portion 40. A stand off post 240 projects downward at an angle from upright portion 40, as illustrated in FIG. 20. A seat pad 42 is adjustably mounted on the base portion 38 via seat support post 44 which is telescopically engaged in an open upper end of a seat support tube 45 on the base portion. The base portion 38 of the user support frame extends forward from the seat support tube 45 and a foot support bar 46 is transversely mounted at the forward end of base portion 38, with a foot support or foot rest 48 mounted at each end of bar 46 for engagement by a user's feet. Bar 46 engages the upper end of post or stand-off 30 in the rest or exercise start position. A back pad 50 and a head rest pad 52 are mounted on the upright portion 40 of the user support frame. As in the first embodiment, the user support pivot axis is located just below the back pad 50 and to the rear of the seat pad 42.

Figure 17:
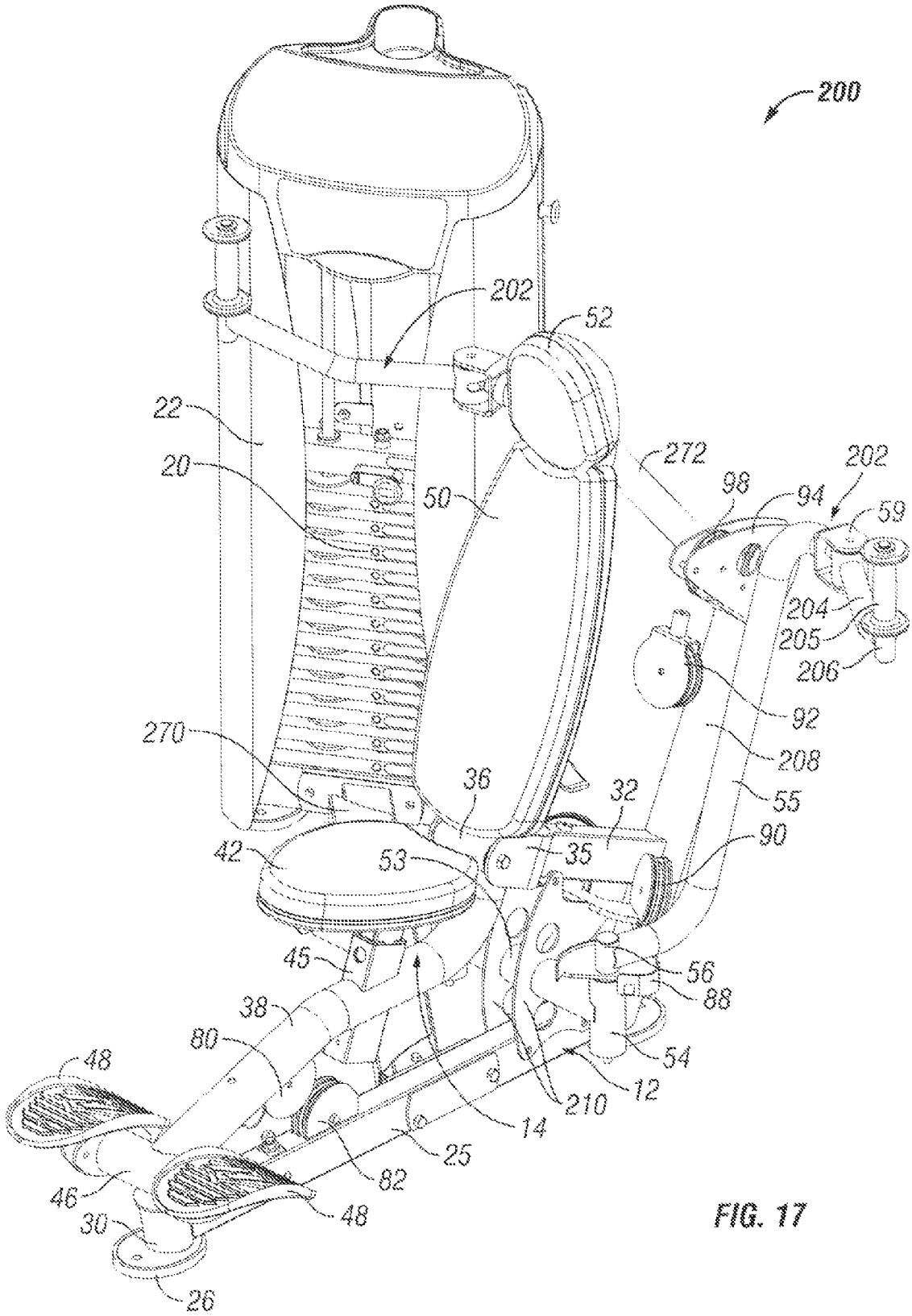
FIG. 17 is a front perspective view of a pec fly exercise machine according to a fourth embodiment in a start position for performing a pec fly exercise.
Figure 18:
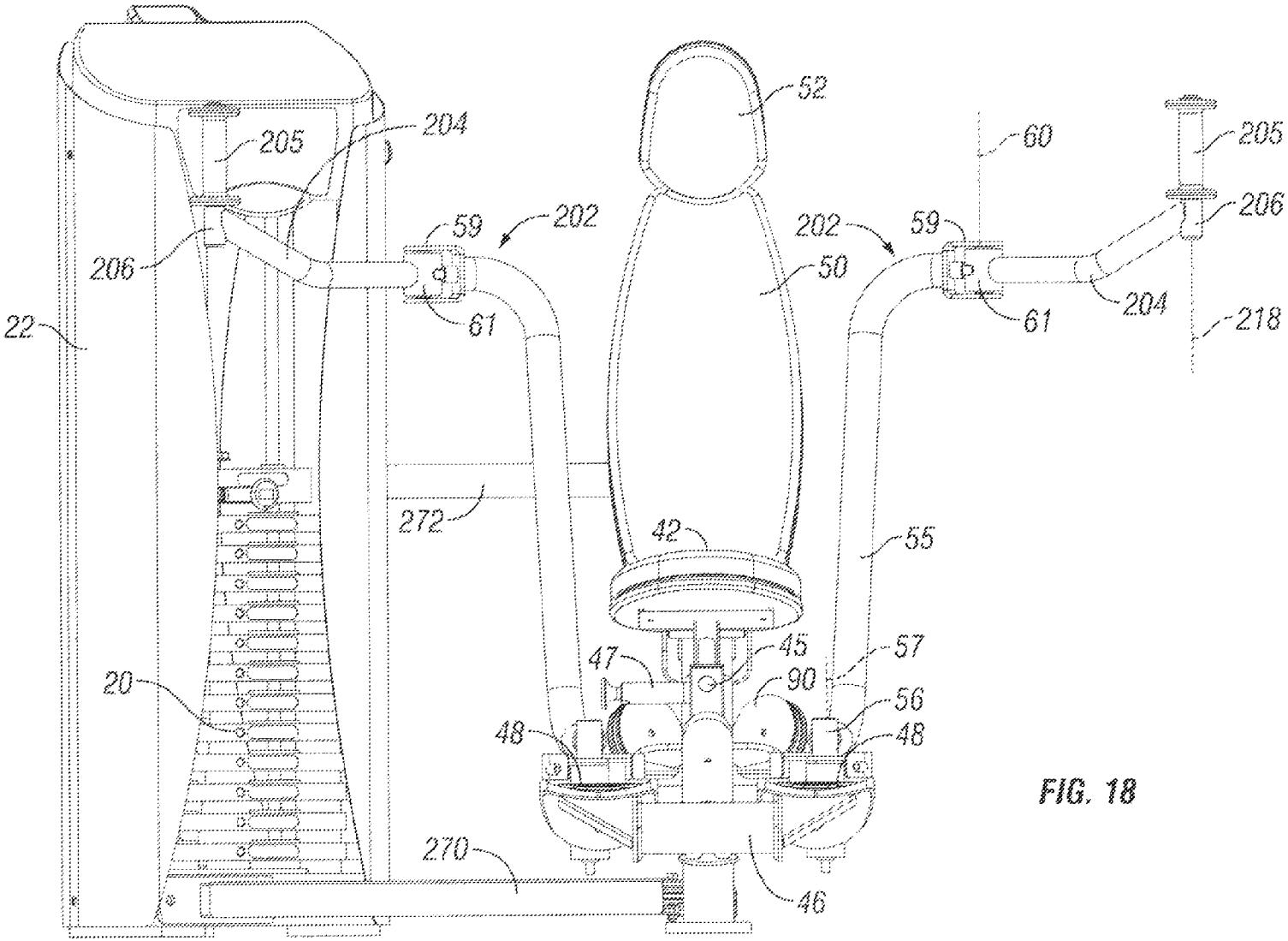
FIG. 18 is a front elevation view of the machine in the same position as FIG. 17.

The multi-part, articulating user engagement devices or exercise arm assemblies 202 have three parallel vertical pivots, unlike the first embodiment where the third pivot axes are at or close to horizontal to the first pivot axes. In the machine 200, the exercise arm assemblies are rotatably mounted on the frame in a similar manner to the first embodiment, and like reference numbers have been used for the arm pivot mounts. Each exercise arm assembly is rotatably mounted via pivot mounts 54 at its first end on the support strut 32 of the main frame, one on each side of the user support, as best illustrated in FIGS. 17 and 19. Each exercise arm has a first elongate part or main arm 55 having a first end pivoted on the respective pivot mount or tube 54 via pivot shaft 56 for rotation about a first pivot axis 57. An elongated handle arm 204 has a first end rotatably mounted on the second end of main arm 55 for rotation about second pivot axis 60 (FIG. 18). In the illustrated embodiment, the pivot connection between main arm 55 and handle arm 204 comprises a generally C shaped bracket 59 secured to the end of arm 55 with a pivot pin extending between the ends of bracket 59, and a sleeve 61 secured to the end of arm 204 and rotatably engaged on the pivot pin. A user-engaging grip 205 is rotatably mounted on the second end of handle arm 204 by means of a pivot pin or shaft 206 welded to the end of arm 204 and rotatably engaged in grip 205 for rotation about a third pivot axis 218 which is parallel to pivot axes 57 and 60, as seen in FIG. 18. Alternatively, a pin or shaft may extend from grip 205 for engagement in a sleeve welded to the end of arm 204.

The pivot mounts or tubes 54 which rotatably support each exercise arm assembly are mounted on opposite sides of the user support in a slightly different arrangement from the first embodiment. Each pivot mount 54 is secured to a respective mounting plate or bracket 210 which is secured to pivot support post 32 and to the base strut 25 of the main frame, as seen in FIGS. 17 and 20. A connecting rod 53 extends transversely through plates 210 and connects to both pivot mounts 54, as best illustrated in FIG. 17. This provides the desired horizontal offset between the strut 34 and pivot mount.

The three pivotal connections in each exercise arm allow the handles to rotate inwardly and outwardly relative to their attachment to the exercise arms, and the combined movement of the main arm and handle arm of the exercise arm assembly 202 about pivot axes 57 and 60 results in forward and rearward elliptical travel paths similar to those of the first embodiment. In this embodiment, the first, second, and third pivot axes 57, 60, and 218 of each exercise arm are vertical, so that the user's hands gripping the hand grips 205 remain in a generally vertical orientation throughout the exercise movement, unlike the first, second, and third embodiments where the hands may be re-oriented throughout an exercise. Since pivot axis 60 is parallel to the first pivot axis and generally vertically oriented, the handle arms in this embodiment do not automatically fall either outward or inward on release. Instead, they move to a neutral position depending on whether the machine base is level, and may fall either inward or outward if the floor on which the base rests is tilted. In an alternative embodiment, the pivot axis 60 may be skewed at an angle to pivot axis 57, as in the first embodiment, to define an outer rest or exercise ready position at the outer stop of the handle arm movement when the arms are released. Alternatively, main arm pivot axis 57 may be skewed to produce the same effect. In another embodiment, the three pivot axes may be parallel, non-vertical pivot axes.

In the embodiment of FIGS. 17 to 21, the weight stack housing 22 is positioned to the rear of the stationary frame 12 and offset to one side of the user support frame 14, as in the first embodiment. Housing 22 is connected to the main frame by a guide tube or channel member 270 extending from the base strut 25 to a lower end of the housing 22 adjacent weight stack 20, and by a connecting strut 272 which extends between the rear side of rear upright 208 and a mounting plate 75 on the rear side of weight stack housing 22, as seen in FIG. 19. Guide tube or channel 270 and connecting strut 272 are similar to the guide tube 70 and connecting strut 72 of the first embodiment, but are of different shape and dimensions to accommodate the weight stack housing position in this embodiment, as best seen by comparison of FIGS. 7 and 19. The same alternative cabling options between the user support frame and weight stack are possible in this embodiment as in the first embodiment, i.e. the easy cabling option of FIGS. 5 and 6 or the hard cabling option of FIGS. 9 and 10.

The cable and pulley linkage between the two exercise arm assemblies 202 and the user support frame 14 is substantially identical to that of the first embodiment, and like reference numbers have been used for like parts as appropriate. As in the first embodiment, the cable and pulley linkage includes a resistance cam or plate 88 mounted on each pivot shaft 56 and having a first cable anchor 93, a pair of angled, oppositely directed pulleys 90 on opposite sides of the pivot support strut 32 of the main frame adjacent the respective cams 88, a floating single pulley 92 suspended from double pulleys 98 in double pulley housing 94 mounted at the upper end of the upright strut 208, and a second cable anchor 99 on the rear of user support frame upright 40. The cables 95 and 96 are not shown in all of the drawings but have identical paths to that of the first embodiment. This cable and pulley linkage provides the connecting link between the user support and exercise arm, and translates forward rotational movement of one or both exercise arms into rearward rotational movement of the user support.

In order to perform a pec fly exercise, a user sits on the seat pad 42 with their feet on foot rests 48 and leans against back pad 50 and head support 52. They then grip the hand grips 205 on each exercise arm assembly 202 with the arms in the start position of FIGS. 17 to 20. In this position, the user's arms are extended to the side and slightly rearward, bent outwards at the elbow, with the hands gripping the hand grips 205 approximately at shoulder height, with the user's upper body oriented in a slightly rearward reclined orientation as determined by the angle of the back rest 50 as seen in FIG. 20. In the start position, the foot rest cross bar 46 is seated on stand off or post 30. The user then extends their arms forward and inward in an arc as in the first embodiment. The connecting linkage 18 between the arm assemblies and the user support frame simultaneously rocks the user support frame rearwards into the end position of FIG. 21, while the cable and pulley linkage between the user support frame and weight stack simultaneously pulls on the cable to lift the selected amount of weight in weight stack 20. In the end position, stand off post 240 on the upright portion of the user support frame rests on the pivot support post 32 on the main frame upright, as seen in FIG. 21.

In the above embodiments, the seat, back rest, and foot support travel together to keep the user in the same position throughout the exercise motion. The user does not have to worry about balancing on a moving platform or pad. The user is placed in an exercise alignment from start to finish. The combined exercise arm and user support movement provide a self-aligning exercise motion that allows the user to achieve a full range of exercise motion and combines traditional exercise machines with free weight movements.

In each of the above embodiments, a user can perform pectoral fly exercises similar to a free weight pectoral fly exercise but without the disadvantages of free weight exercises. Each machine is designed to move or rock the user from a slightly rearwardly reclined position to a more rearwardly reclined position as the user moves their arms forwardly and inwardly in a slight elliptical or arcuate path similar to that of a free weight pectoral fly movement, gripping handles which are connected to a flexible cable linkage or to an articulated exercise arm which in turn is linked to the user support frame, providing a user-defined exercise path. This arrangement is found to exercise the lower or mid to lower pectoral muscles with less shoulder muscle involvement than in the pec fly machine described in co-pending application Ser. No. 10/633,805 referenced above.

By linking movement of the user support to movement of the exercise arm and positioning the user support pivot so that the combined weight of the user support and user is distributed on both sides of the gravitational centerline, the user support provides a counter-balancing effect on the exercise arm as it moves and its weight is re-distributed. This balanced weight distribution positions a portion of the user and user support on each side of the gravitational centerline in both the start and finish positions. As the exercise arm is moved, a portion of this combined weight passes through the gravitational centerline, re-distributing the weight. This re-distribution is gradual and continuous throughout the exercise motion and is not noticed by the user.

The rocking movement of the user support can make the exercise more fun to perform. Repetitious exercise movement can be tedious and boring. By adding motion to the user support, performing the exercise may be enjoyable and the user's interest in their workout may increase. This is a benefit to both the individual user, who may be motivated to exercise more regularly, and the fitness facility, where retention of members is a primary objective. The rocking movement also activates core muscle groups in the stomach, back and hips of the seated user during the exercise as the upper body changes orientation, due to the instinctive balancing effect which occurs when the body is tilted. This helps to strengthen core muscle groups as well as the pectoral muscles involved in the exercise.

In several of the above embodiments, such as the first, third and fourth embodiment, the weight stack and frame can be positioned on either side of the main frame and user support, as desired. The guide tube and connecting rod between the main frame and weight stack frame are releasably connected to one or both frames, and can be removed to allow the weight stack frame to be reversed and placed on the opposite side of the machine. The guide tube and connecting rod are then re-attached and the cable and pulley linkage re-connected.

It should be understood that all the different elements used in the various embodiments may be mixed and interchanged with one another. The back pad could be made adjustable; various types of user engaging handles could be used; the exercise arm could be unidirectional or bi-directional and may be an articulated exercise arm or a flexible line; the connecting linkages could be made adjustable, and the connecting linkage could be made to push or pull to urge rotation of the user support. Any of the various designs could have the resistance associated with any of the moving parts (user support, exercise arm or connecting link).

It should also be noted that different types and forms of components could be used in the above embodiments without affecting the scope of this invention. Cables could be replaced with belts, ropes, chains or the like, pulleys replaced with sprockets, and tubes could be replaced with solid rods or bars. Other types of resistance know to the art could by used instead of the weight stack, such as weight plates, hydraulic, pneumatic, electro-magnetic or elastic band resistance.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An exercise machine, comprising:

a stationary main frame having a rear end and a forward end;

a user support frame pivotally mounted on the main frame which supports a user in an exercise position between an exercise start position and an exercise end position of the user support frame, the user support frame having primary and secondary user supports which move together to support spaced positions on a user's body in the same relative positions throughout an exercise movement;

a user engagement device pivotally mounted on one of the frames and having at least one handle which is engaged and moved by the user in at least one path corresponding to an exercise;

a connecting linkage which translates an exercise movement of the user engagement device into movement of the user support frame from an exercise start position to an exercise end position;

a load which resists movement of the user support frame, user engagement device, or connecting linkage;

an elongate flexible, load-bearing connecting linkage extending between the load and user support frame;

first and second spaced anchors each configured for selective releasable connection to one end of the load-bearing connecting linkage, whereby the resistance felt by the user can be varied by attaching the load-bearing connecting linkage to the first anchor or second anchor; and at least the first anchor being located on the user support frame.

2. The machine of claim 1, wherein the exercise machine is configured for performance of an upper body exercise and the handle is configured to move in an exercise path corresponding to the upper body exercise.

3. The machine of claim 1, wherein the exercise machine is configured for performance of a chest exercise and the handle is configured to move in an exercise path corresponding to the chest exercise.

4. The machine of claim 1, further comprising a pulley mounted on the user support frame, the load-bearing connecting linkage extending around the pulley before connection to a selected anchor.

5. The machine of claim 4, wherein the second anchor is located on the main frame.

6. The machine of claim 1, wherein the user support frame supports a user in a seated position, the primary support comprises a seat pad and the secondary support comprises an upper body engaging pad.

7. The machine of claim 6, wherein the secondary support comprises a back pad.

8. The machine of claim 7, wherein the secondary support further comprises a head engaging pad at an upper end of the back pad.

9. The machine of claim 6, wherein the seat pad is adjustable in height.

10. The machine of claim 6, further comprising an additional support which supports a different part of a user's body from the seat and upper body pads.

11. The machine of claim 10, wherein the additional support comprises a foot support for the user's feet.

12. The machine of claim 1, wherein the user engagement device comprises a pair of user engaging portions located on opposite sides of the user support frame, each user engaging portion having a handle and being moveable in a user-defined exercise path.

13. The machine of claim 12, wherein each user engaging portion comprises an articulated exercise arm.

14. The machine of claim 13, wherein each exercise arm has a main arm portion pivotally associated with the main frame for rotation about a first pivot axis and a handle arm portion pivotally associated with the main arm portion for rotation about a second pivot axis.

15. The machine of claim 14, wherein the main frame has a base portion beneath the user support frame and the main arm portion of each exercise arm is pivotally associated with the base portion.

16. The machine of claim 14, wherein the main frame has an upper portion extending above the user support frame and the main arm portion of each exercise arm is pivotally associated with the upper portion.

17. The machine of claim 14, wherein each handle is pivotally associated with the handle arm portion of the respective exercise arm for rotation about a third pivot axis.

18. The machine of claim 14, wherein at least one of the pivot axes is a vertical axis.

19. The machine of claim 18, wherein the first pivot axis is a vertical axis.

20. The machine of claim 17, wherein at least one of the pivot axes is not parallel to the other two pivot axes.

21. The machine of claim 20, wherein each pivot axis is non-parallel with the other two pivot axes.

22. The machine of claim 21, wherein each pivot axis is non-perpendicular to the other two pivot axes.

23. The machine of claim 19, wherein the second pivot axis is skewed outward at a predetermined angle relative to the first pivot axis, whereby each handle arm portion falls into an outer rest position away from the user support frame when released.

24. The machine of claim 17, wherein the third pivot axis is substantially horizontal.

25. The machine of claim 24, wherein the exercise arm assembly has an exercise start position and the third pivot axis is angled outward from the rear to the forward end of the machine in the exercise start position.

26. The machine of claim 1, wherein the load comprises a weight stack selectively connectable to the main frame on either side of the user support frame.

27. The machine of claim 1, wherein the connecting linkage comprises a flexible linkage.

28. The machine of claim 27, wherein the connecting linkage comprises a cable and pulley assembly extending between the user engagement device and the user support frame.

29. The machine of claim 28, wherein the cable and pulley assembly comprises at least one pulley mounted on the main frame and a cable which extends around the pulley.

30. The machine of claim 28, wherein the user engagement device comprises first and second articulated exercise arms located on opposite sides of the user support frame, each exercise arm having a handle and being selectively moveable in a user-defined exercise path, and the cable and pulley assembly comprises at least one cable extending between the exercise arms and linked to the user support frame.

31. The machine of claim 1, wherein the load-bearing connecting linkage further comprises a series of pulleys, one of the pulleys being located on the main frame beneath the user support frame and another one of the pulleys being located on the user support frame, the flexible member extending around the pulley on the main frame and the pulley on the user support frame before anchoring to a selected one of the first and second anchor points.

32. The machine of claim 1, wherein the connecting linkage comprises a first cable and pulley assembly and the load-bearing connecting linkage comprises a second cable and pulley assembly.

33. The machine of claim 1, further comprising a user support pivot mount on the main frame, the user support frame being pivotally connected to the pivot mount for rotation about a user support pivot axis, the user support pivot mount defining a vertical gravitational center line of the pivotal movement of the user support frame which extends through the user support pivot axis, and portions of the combined weight of the user and user support frame being positioned on opposite sides of the gravitational center line in at least one of the start and end position of the chest exercise.

34. The machine of claim 33, wherein the user support frame comprises a generally L-shaped support having a base portion and a generally upright portion, the primary user support comprises a seat pad on the base portion, and the user support pivot axis is located on the upright portion of the user support frame to the rear of the seat pad.

35. The machine of claim 1, wherein the user engagement device and user support frame move in opposite directions during an exercise.

36. The machine of claim 1, wherein the user support frame is oriented at different angles in exercise start and end positions.

* * * * *